US011559145B1

(12) United States Patent
Flannery et al.

(10) Patent No.: US 11,559,145 B1
(45) Date of Patent: Jan. 24, 2023

(54) FLOOR SEAT APPARATUS

(71) Applicant: Regalo International, LLC, Longboat Key, FL (US)

(72) Inventors: Mark A. Flannery, Longboat Key, FL (US); Gary T. Schultze, Savage, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 17/713,165

(22) Filed: Apr. 4, 2022

Related U.S. Application Data

(63) Continuation of application No. 17/221,826, filed on Apr. 4, 2021, now Pat. No. 11,291,311, which is a continuation of application No. 16/876,121, filed on May 18, 2020, now Pat. No. 10,966,543, which is a continuation of application No. 15/849,674, filed on Dec. 21, 2017, now Pat. No. 10,653,250.

(60) Provisional application No. 62/438,414, filed on Dec. 22, 2016.

(51) Int. Cl.
*A47D 1/00* (2006.01)
*A47C 7/00* (2006.01)
*A47C 7/02* (2006.01)

(52) U.S. Cl.
CPC ..... *A47D 1/0085* (2017.05); *A47C 7/002* (2013.01); *A47C 7/029* (2018.08)

(58) Field of Classification Search
CPC ..... A47D 1/0085; A47D 1/00; A47C 7/002; A47C 7/029
See application file for complete search history.

(56) References Cited

U.S. PATENT DOCUMENTS

| | | | | |
|---|---|---|---|---|
| 6,033,019 | A * | 3/2000 | Hession-Kunz | A47D 1/0085 297/256.13 |
| 6,626,487 | B1 * | 9/2003 | Buitendach | A47D 1/00 297/467 |
| D553,865 | S | 10/2007 | Buitendach | |
| D570,970 | S | 6/2008 | Buitendach | |
| D667,229 | S | 9/2012 | Sturmey | |
| 9,603,464 | B2 * | 3/2017 | Sclare | A47D 1/0085 |
| 2003/0067198 | A1 * | 4/2003 | Treen | A47D 1/103 297/250.1 |
| 2008/0054696 | A1 * | 3/2008 | McConnell | A47D 15/006 297/256.15 |
| 2014/0368004 | A1 * | 12/2014 | Sclare | A47D 1/0085 297/135 |
| 2015/0351558 | A1 * | 12/2015 | Visser | A47D 15/006 297/239 |
| 2017/0119172 | A1 * | 5/2017 | Sclare | A47D 1/0085 |
| 2018/0279799 | A1 * | 10/2018 | Ingraham | A47D 1/103 |
| 2018/0279801 | A1 * | 10/2018 | Ingraham | A47D 1/0083 |

FOREIGN PATENT DOCUMENTS

WO 2014111762 A1 7/2014

* cited by examiner

*Primary Examiner* — Gary C Hoge

(57) ABSTRACT

The present floor seat apparatus includes a base, a seat removably seatable in the base, and a tray engagable to the base. The base may be used as a seat by itself, with or without the seat and with or without the tray. The base includes a post. The seat includes a post through opening that engages the post and positions the seat in the seat receptacle of the base.

7 Claims, 15 Drawing Sheets

FLOOR SEAT APPARATUS

This application is a continuation, and claims the benefit under 35 U.S.C. § 120, of U.S. Nonprovisional patent application Ser. No. 17/221,826 filed Apr. 4, 2021, which application is a continuation, and claims the benefit under 35 U.S.C. § 120, of U.S. Nonprovisional patent application Ser. No. 16/876,121 filed May 18, 2020, which application is a continuation, and claims the benefit under 35 U.S.C. § 120, of U.S. Nonprovisional patent application Ser. No. 15/849,674 filed Dec. 21, 2017, which claims the benefit under 35 U.S.C. 119(e) of U.S. Provisional Patent Application No. 62/438,414 filed Dec. 22, 2016, all of which applications are hereby incorporated by reference in their entireties into this application.

FIELD OF THE INVENTION

The present invention relates to a floor seat apparatus for a child, particularly relates to a floor seat apparatus having a base, a seat removably seatable in the base, and a tray engagable to the base and specifically relates to such a floor seat apparatus for an infant.

BACKGROUND OF THE INVENTION

A floor seat is an apparatus that is an intermediate structure between the floor and a child. A floor is usually flat. A floor may be hard. A floor may be soft. A child may be restless on a floor, but less restless in a floor seat. A child may be served lunch on the floor, but may enjoy lunch more in a floor seat with or without a tray. A child may have difficulty sitting up straight while in a sitting position on a floor, but likely has less difficulty sitting up straight in a floor seat that has a back. A child may have a greater tendency to interact physically with others while on the floor, but will be somewhat spaced from other children when all children are in floor seats.

A floor seat is a support mechanism. Where the child is an infant and unable to hold himself or herself upright in a sitting position, the floor seat provides a means to hold the infant upright in a sitting position.

A floor seat offers protection. The child, especially an infant, is protected from being kicked or stepped upon, such as by a caregiving rushing to help another child.

SUMMARY OF THE INVENTION

A feature of the present invention is a seat apparatus for resting on a surface such as a floor.

Another feature of the present invention is the provision in a floor seat apparatus, of a base.

Another feature of the present invention is the provision in a floor seat apparatus, of a seat that is seatable in the base.

Another feature of the present invention is the provision in a floor seat apparatus, of a seat that is removably seatable in the base.

Another feature of the present invention is the provision in a floor seat apparatus, of a tray that is engagable to the base.

Another feature of the present invention is the provision in a floor seat apparatus, of the base including an outer and inner wall.

Another feature of the present invention is the provision in a floor seat apparatus, of the outer wall having a front portion, a right side portion, a left side portion, and a back portion.

Another feature of the present invention is the provision in a floor seat apparatus, of the inner wall having a front portion, a right side portion, a left side portion, and a back portion.

Another feature of the present invention is the provision in a floor seat apparatus, of the inner wall spaced from the outer wall.

Another feature of the present invention is the provision in a floor seat apparatus, of an integral base bottom integrally joined to the front portion, right and left side portions and back portion of the inner wall.

Another feature of the present invention is the provision in a floor seat apparatus, of the outer and inner walls integrally joined at an integral upper junction extending about the base such that the base is integral and one-piece.

Another feature of the present invention is the provision in a floor seat apparatus, of the front portions of the outer and inner wall including a post and further including first and second U-shaped openings, where the post extends upwardly and is between the first and second U-shaped openings.

Another feature of the present invention is the provision in a floor seat apparatus, of the inner wall and bottom defining a seat receptacle.

Another feature of the present invention is the provision in a floor seat apparatus, of the seat being removably seatable in the seat receptacle of the base.

Another feature of the present invention is the provision in a floor seat apparatus, of the seat having a child receptacle with a front wall, a right side wall, a left side wall, a back wall, and a seat bottom.

Another feature of the present invention is the provision in a floor seat apparatus, of a seat front portion including first and second U-shaped leg receptors and a post through opening between the first and second U-shaped leg receptors, where the post through opening receives the post of the base when the seat is seated in the base.

Another feature of the present invention is the provision in a floor seat apparatus, of the seat including a peripheral lip, where the peripheral lip extends outwardly from the front wall, right side wall, the left side wall, and the back wall of the seat, and where the peripheral lip confronts at least a portion of the integral upper junction of the base.

Another feature of the present invention is the provision in a floor seat apparatus, of the integral upper junction including a right wall portion, a left wall portion, a back wall portion, and a post forming portion, where the peripheral lip confronts each of the right wall portion, the left wall portion, the back wall portion, and where the peripheral lip is spaced from the post forming portion.

Another feature of the present invention is the provision in a floor seat apparatus, of the integral upper junction including first and second U-shaped portions and a post upper junction portion, where each of the first and second U-shaped portions include outer and inner junction sections and a bottom section, and where the integral upper junction of the peripheral lip confronts the outer junction sections and the bottom section and is spaced from the inner junction sections.

Another feature of the present invention is the provision in a floor seat apparatus, of the base being formed of a plastic having a first degree of hardness, where the seat is formed of a plastic having a second degree of hardness, and where the base has a greater degree of hardness than the seat.

Another feature of the present invention is the provision in a floor seat apparatus, of the outer wall including a lower peripheral edge confronting the surface, where the lower peripheral edge is spaced from the integral upper junction, where the outer wall tapers upwardly and inwardly from the lower peripheral edge to the integral upper junction such that the integral upper junction is disposed inwardly of the lower peripheral edge.

Another feature of the present invention is the provision in a floor seat apparatus, of the outer wall curving upwardly and inwardly from the lower peripheral edge to the integral upper junction.

Another feature of the present invention is the provision in a floor seat apparatus, of the lower peripheral edge including a front section, right side section, left side section and back section, where each of the front section, right side section, left side section and back section curves in a horizontal direction.

Another feature of the present invention is the provision in a floor seat apparatus, of the post including a post front wall, a post right side wall, a post left side wall, and a post rear wall, where the post front wall tapers upwardly and inwardly, where the post rear wall extends vertically, where the post front wall, post right side wall, post left side wall, and post rear wall form an elongate upper junction.

Another feature of the present invention is the provision in a floor seat apparatus, of the post including a generally rectangular front side, a generally rectangular rear side, a right side triangular side, a left side triangular side, and a generally rectangular rear side, where the post includes an integral post base that extends rearwardly into the integral base bottom.

Another feature of the present invention is the provision in a floor seat apparatus, of the post through opening of the seat being defined by a front wall, right side wall, left side wall, and rear wall, where the front wall tapers upwardly and inwardly, where the right side wall, left side wall, and rear wall extend integrally from the bottom of the child receptacle.

Another feature of the present invention is the provision in a floor seat apparatus, of the outer wall including an inner surface and a lower peripheral edge, where the inner wall includes an inner surface, where the integral upper junction includes an inner surface, where the inner surfaces of the outer and inner walls oppose each other and are spaced apart from each other, and of a first integral rib, where the first integral rib includes an outer wall rib portion, an inner wall rib portion, an integral upper junction rib portion, and an integral base bottom rib portion, where the outer wall rib portion extends upwardly from the lower peripheral edge and is disposed integrally on the inner surface of the outer wall, where the integral rib portions are in a first plane, where the integral rib portions are integral with each other, and where the integral rib portions are joined integrally end to end.

Another feature of the present invention is the provision in a floor seat apparatus, of a second integral rib spaced apart from the first integral rib and being in a second plane, where the first and second planes intersect each other at a central portion of the integral base bottom.

Another feature of the present invention is the provision in a floor seat apparatus, of the first integral rib including a proximal end disposed at the lower peripheral edge of the outer wall and a distal end disposed on the integral base bottom, where the distal end is integrally joined to an elongate ridge extending downwardly from the integral base bottom, where the elongate ridge and lower peripheral edge include bottommost portions in a common plane to stabilize the floor seat apparatus.

Another feature of the present invention is the provision in a floor seat apparatus, of the integral base bottom rib portion and the lower peripheral edge including bottommost portions in a common plane to stabilize the floor seat apparatus.

Another feature of the present invention is the provision in a floor seat apparatus, of the integral base bottom including an undersurface and an endless ridge extending from the undersurface, where the endless ridge confronts the surface on which the floor seat apparatus rests, where the outer wall includes a lower peripheral edge, where the lower peripheral edge confronts the surface on which the floor seat apparatus rests, where each of the endless ridge and lower peripheral edge include bottommost portions that are disposed in a common plane to provide a stable floor seat apparatus.

Another feature of the present invention is the provision in a floor seat apparatus, of the base including a lower peripheral edge, where the seat includes a peripheral lip, where the peripheral lip includes a right side wall portion, a left side wall portion, a back wall portion, and a seat front portion, where the right side wall portion and left side wall portion of the seat extend parallel to the lower peripheral edge of the base when the seat is seated in the base, where the back wall portion of the peripheral lip is at a greater elevation than the right and left side wall portions of the peripheral lip and extends obliquely therefrom, where the seat front portion of the peripheral lip is at a lesser elevation than the right and left side wall portions of the peripheral lip and extend obliquely therefrom.

Another feature of the present invention is the provision in a floor seat apparatus, of a tray apparatus, where the tray apparatus includes first and second arms and a tray, where each of the first and second arms include a proximal end extending from the tray, where each of the first and second arms include a distal end engaged to the base, and where the tray includes an under portion that engages the post.

Another feature of the present invention is the provision in a floor seat apparatus, of the outer wall including a lower peripheral edge, and of sections of the front portion, right side portion, left side portion and back portion of the outer wall defining surface portions of a frustoconical structure between the lower peripheral edge and the integral upper junction.

An advantage of the present invention is a floor seat apparatus that is easy for a caregiver to use. The caregiver may easily place a child in the floor seat apparatus and may easily take him or her out. The tray apparatus swings easily into position or to an out-of-the-way position. The tray apparatus is easy to put on and take off.

Another advantage is comfort. One feature contributing to this advantage is the resilient seat. The material from which the seat is formed is resilient such that the seat as a whole is resilient, including a) the seat bottom for the buttocks, b) the back wall against which the child's back rests, c) the right side and left side wall that may confront the child's torso, d) the post receiver including the rear wall of the post receiver, e) a front portion on which the legs of a child may rest, and f) a peripheral lip upon which a child may rest his or her arms.

Another advantage is seat stability. Generally, the base is frustoconically shaped such that a child sits in a middle of the cone shaped base, which then flares out to a lower peripheral edge that confronts the floor. Another feature that contributes to this advantage is the endless circular ridge that depends from the undersurface of the integral base bottom such that, when the child sits down, flexing of the floor seat apparatus as a whole is minimized. The endless circular ridge is disposed generally in a common plane with the lower peripheral edge of the cone shaped base.

Another advantage is easy operation. For example, the tray apparatus includes arms that have distal end connections that snappingly engage ears formed on the right and left side portions of the base. The distal end connections and ears provide for a swinging tray that swings up and over the head of a child to permit a caregiver to take the child out of the floor seat apparatus without taking the tray off the floor seat apparatus.

Another advantage is tray stability. The tray apparatus includes a tray having an underside that rests upon the post. The post includes an elongate upper edge that minimizes wobble of the tray.

Another advantage is that the floor apparatus is easy and inexpensive to manufacture. The base is molded, integral and one-piece. The seat is integral, molded and one-piece. The tray is integral, molded and one-piece.

Another advantage is that the present floor seat apparatus is easy to keep clean. Smooth surfaces are maximized. Smooth surfaces are easy to wipe down and can be wiped down quickly.

Another advantage of the present floor seat apparatus is that it is aesthetic. The circular and cone shaped base is pleasing to many eyes.

Another advantage of the present floor seat apparatus is that it is light and easy to carry. The base, seat and tray are formed of a relatively light plastic. The base includes a depression or dimple to suggest a position to place one's hands, which depression or dimple reduces the tendency of a hand to slip on a perfectly circular or perfectly conical structure.

Another advantage is a removable seat with minimal slippage. A feature contributing to this advantage is the post receiver of the removable seat that engages the post of the base.

Another advantage of the present invention is that the floor seat apparatus is a protective device. The top of a head of an infant may be lower than the highest point of the seat or base of the floor seat apparatus when the infant is seated in the floor seat apparatus. The top of the shoulders of an infant may be lower than the sides of the seat or base of the floor seat apparatus when the infant is in the floor seat apparatus.

Another advantage is that, even where the head and shoulders of the infant are at an elevation higher than the back and sides of the floor seat apparatus, the 360 degree structure provides 360 degrees of protection.

Another advantage is that the present floor seat apparatus provides protection to a substantial height up the torso of the infant, not just up to the stomach or hips of the infant. Generally, the floor seat apparatus protects the torso of the infant up to about the shoulders of the infant.

DESCRIPTION

Figure 1:
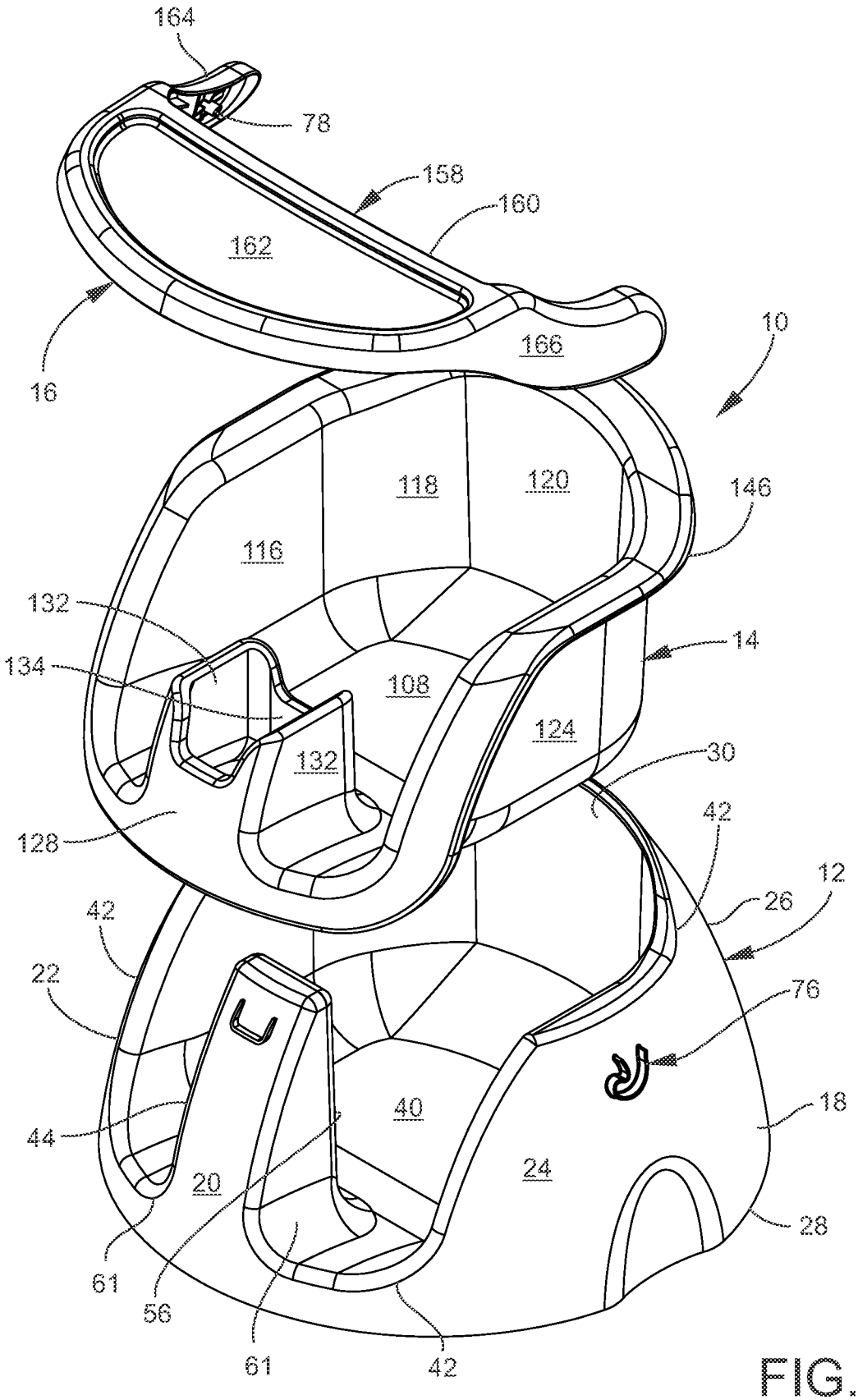
FIG. 1 is an exploded perspective view of the present floor seat apparatus, showing the base, seat and tray apparatus.

As shown in FIG. 1, the present floor seat apparatus is indicated by reference number 10. The present floor seat apparatus 10 includes a base 12, a seat 14 removably seatable in the base 12, and a tray apparatus 16 removably and swingably engaged to the base 12.

The floor seat apparatus 10 is intended for use as a support mechanism for an infant that cannot sit upright on his or her own, such as an infant who cannot sit in an upright fashion by himself or herself in a cross legged fashion on the floor or in any manner on the floor with his or her back in an upright position. An infant may be a baby anywhere from one day old to about six months old. At this age, the seat or foam insert 14 is used with the base 12. At six to nine months of age the child likely has a larger torso, and such a larger child may be using the floor seat apparatus 10 without the seat 14 such that the larger child is sitting directly in and on the base 12. It is noted that, generally, a nine month old child may not be able to physically do much other than crawl.

Base 12 includes an outer wall 18. Outer wall 18 includes a front portion 20, a right side portion 22, a left side portion 24 and a back portion 26. The outer wall 18 further includes a lower peripheral edge 28.

Figure 10:
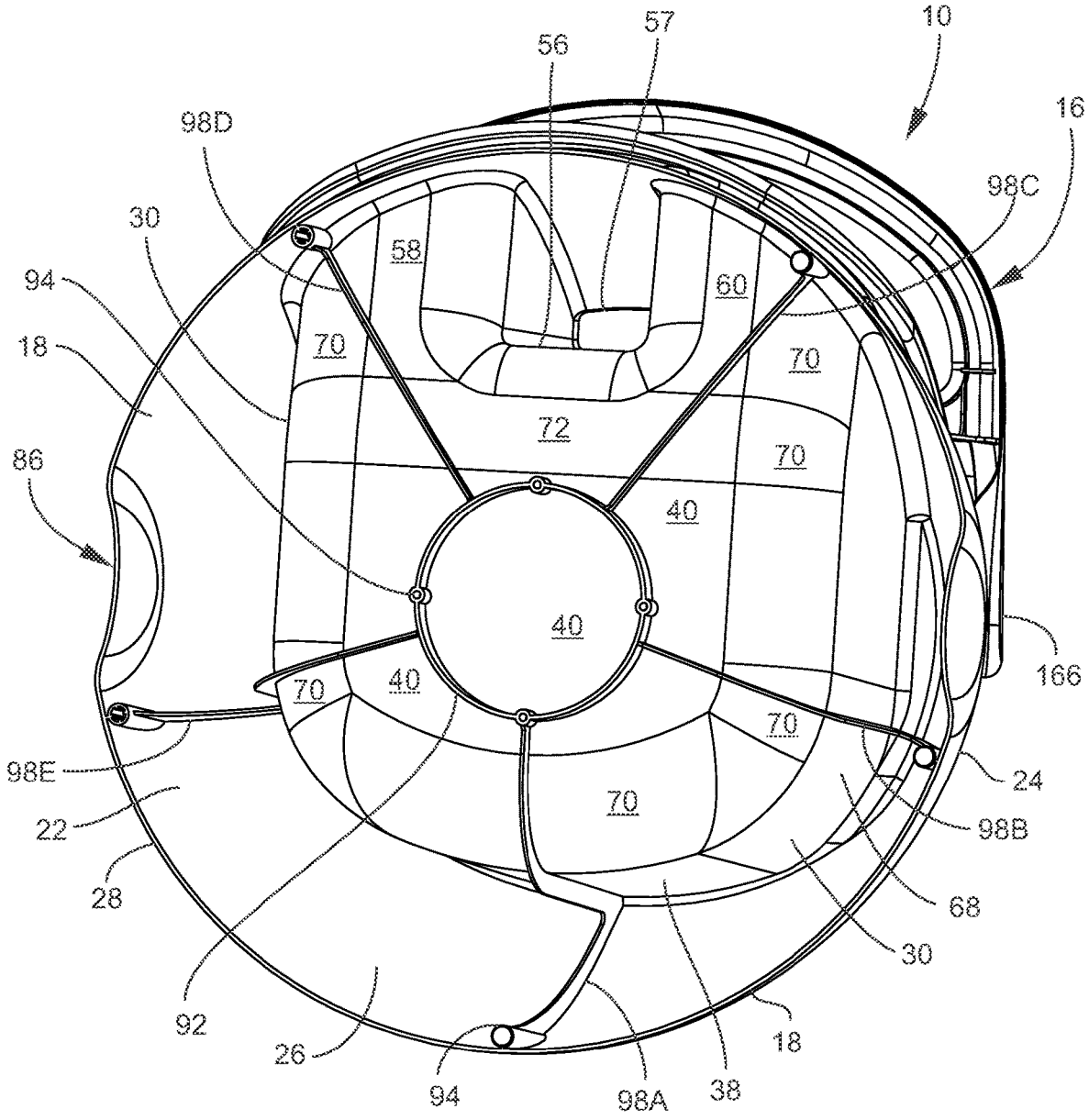
FIG. 10 is a bottom perspective view of the floor seat apparatus of FIG. 4.

Base 12 includes an inner wall 30. Inner wall 30 includes a front portion 32, a right side portion 34, a left side portion 36, and a back portion 38. As shown in FIG. 10, the inner wall 30 is spaced from the outer wall 18.

Base 12 includes an integral base bottom 40 integrally joined to the front portion 32, the right side portion 34, the left side portion 36 and the back portion 38.

The outer and inner walls 18, 30 are integrally joined at an integral upper junction 42 that extends about the base 12 such that the base 12 is integral and one-piece.

Figure 2:
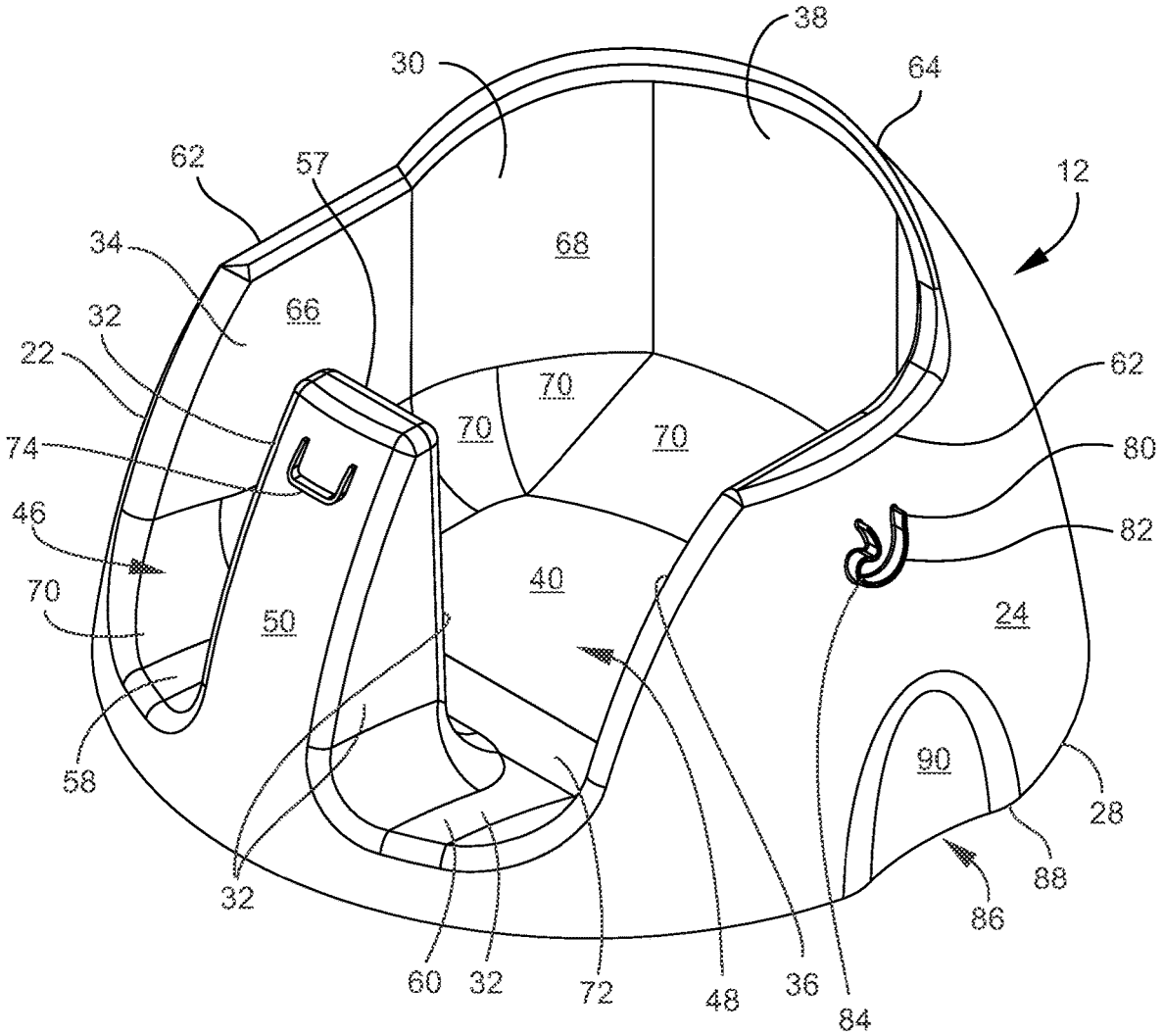
FIG. 2 is a perspective isolated view of the base of the floor seat apparatus of FIG. 1.

As shown in FIG. 2, the front portion 20 of the outer wall 18 and the front portion 32 of the inner wall 30 form a post 44, a right side U-shaped opening 46, and a left side U-shaped opening 48. The front portion 20 of the outer wall 18 forms a post front side 50 that is generally rectangular and that tapers or curves upwardly and inwardly, a post right side 52 that is generally triangular and that rises vertically, a post left side 54 that is generally triangular and that rises vertically, and a post rear side 56 that rises vertically and is generally rectangular. The post right side 52, the post left side 54 and the post rear side 56 rise in respective planes that are disposed at a right angle to a plane defined by the lower peripheral edge 28. The post front side 50, post right side 52, post left side 54 and post rear side 56 form a portion 57 of the integral upper junction 42. Portion 57 can be referred to as an elongate upper post edge.

The U-shaped openings 46, 48 are defined by U-shaped portions of the integral upper junction 42. The right side U-shaped opening 46 is further defined by the post right side 52, an opposing section of the right side portion 34 of the inner wall 30, and a lower inclined section 58 of the front portion 32 of the inner wall 30. The left side U-shaped opening 48 is further defined by the post left side 54, an opposing section of the left side portion 36 of the inner wall 30, and a lower inclined section 60 of the front portion 32 of the inner wall 30. Lower inclined sections 58, 60 of the front portion 32 of the inner wall 30 are ramps that increase in elevation from the transverse ramp 72, which in turn increases in elevation from the base bottom 40 to the integral upper junction 42. Lower inclined sections or ramps 58, 60 confront the undersides of the thighs of a child sitting in the floor seat apparatus 10.

Lower inclined sections or ramps 58, 60 lead down into and up out of the inside of the inner wall 30. Base bottom 40 is disposed at an elevation lower than any portion of lower inclined sections or ramps 58, 60. Base bottom 40 is disposed at an elevation lower than transverse ramp 72.

Post 44 includes a post base 61 that is defined by post front side 50, post right side 52, post left side 54, and post rear side 56. Post base 61 is defined by the transition sections of post right side 52, post left side 54 and post rear side 56 that curve into the lower inclined sections or ramps 58, 60 and that curve into the base bottom 40. Post base 61 extends in a horizontal manner into the base bottom 40 or into the seat receptacle of the base 12 and away from the front portion 20 of the outer wall 18. Post base 61 is U-shaped. Post base 61 is concave relative to the seat 12 when the seat 12 is engaged in the base 12.

Integral upper junction 42 includes undulating portions and straight portions about the base 12. Upper junction 42 runs in an inverted U-shaped manner about three sides of the post 44. Upper junction 42 runs in a U-shaped manner to form the right and left side U-shaped openings 46, 48. From each of the U-shaped openings 46, 48, upper junction 42 includes a straight portion 62. Straight portion 62 is found on each of the left and right sides of the base 12. Straight portion 62 is parallel to a plane defined by the lower peripheral edge 28 of the base 12. Right side and left side straight portions 62 lie in a plane with each other. Rear ends of the straight portions 62 are joined by a semi-circular portion or back or neck confronting portion 64 of the integral upper junction 42. The portions of the integral upper junction 42 that are below the elevation of the straight portions 62 are the portions of the integral upper junction 42 that define the right and left side U-shaped openings 46, 48, except for post upper edge or junction portion 57, which is generally at about the elevation of the straight portions 62. The portions of the integral upper junction 42 that are at a greater elevation than the straight portions 62 include those portions of the integral upper junction 42 that make up the back or neck confronting junction portion 64. Back portion 38 of the inner wall 30 and semi-circular portion 64 may support the back and/or neck of a child in the floor seat apparatus 10.

The inner wall 30 and base bottom 40 define a seat receptacle for the seat 14. The inner wall 30 includes front portion 32, right side portion 34, left side portion 36 and back portion 38.

The front portion 32 of the inner wall 30 includes the rear side 56 of the post 44, the right and left sides 52, 54 of the post 44, ramps 58, 60, and transverse ramp 72.

The right side portion 34 of the inner wall 30 includes vertical surfaces or sections 66, 68. Vertical surface 68 is a transition surface that curves into back portion 38 of the inner wall 30. The left side portion 36 of the inner wall 30 also includes such vertical surfaces 66, 68.

Disposed between the vertical surfaces 66, 68 of the right and left side portions 34, 36 of the inner wall 30 and the base bottom 40 is a curved elongate surface or section 70. Curved elongate surface 70 is a transition surface from the vertical surfaces 38, 66, 68 to the base bottom 40. Curved elongate surface 70 runs from the right side U-shaped opening 46 to the left side U-shaped opening 48. Curved elongate surface 70 is a concave surface relative to where the child sits in the floor seat apparatus 10 to provide comfort to the child.

As shown in FIG. 2, disposed immediately inwardly of the inner ends of the ramps 58, 60 is the transverse ramp or surface or section 72 that is slightly inclined. Transverse ramp 72 can be defined as being part of the front portion 32 of the inner wall. Slightly ramped surface 72 runs between opposing portions of the curved elongate surface 70 and is disposed immediately inwardly of the post 44 and the post base 61 and immediately forwardly of the base bottom 40. Transverse ramp 72 rises from the base bottom 40 to the ramps 58, 60. Ramps 58, 60 have a greater degree of incline than does transverse ramp 72.

Base bottom 40 may be a flat section. Base bottom 40 is bounded by curved elongate surface 70 and transverse ramp 72.

Inner wall 30 further includes back portion 38. Back portion 38 is disposed between and curves between transition surface 68 of the right side portion 34 and the like transition surface of the left side portion 36. Back portion 38 rises vertically from curved elongate surface 70.

Back portion 38, surface portions 66, 68 of the right and left side portions 34, 36, and the post rear side 56 are disposed at a generally right angle relative to a plane defined by the lower peripheral edge 28. Bottom base 40 defines a plane that is parallel to a plane defined by the lower peripheral edge 28.

As shown in FIG. 2, post front side 50 includes a U-shaped ridge 74 extending outwardly from a front surface of the post front side 50. U-shaped ridge 74 includes a bottom, a right side and a left side. U-shaped ridge 74 interacts with the tray apparatus 16.

Figure 11A:
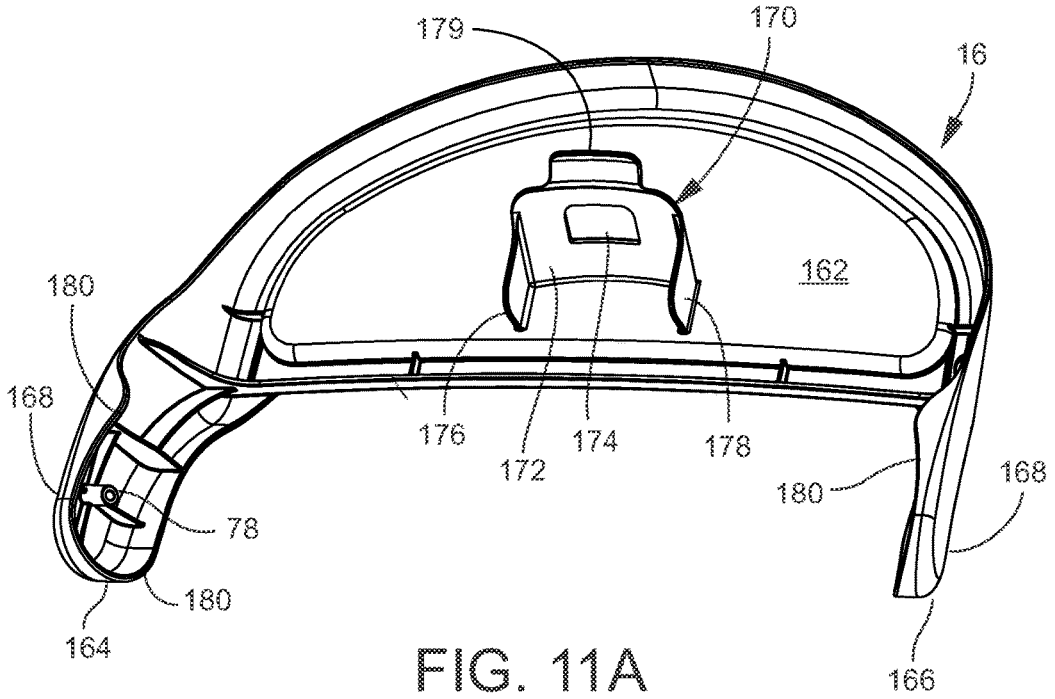
FIG. 11A is a bottom perspective isolated view of the tray apparatus of FIG. 1.
Figure 11B:
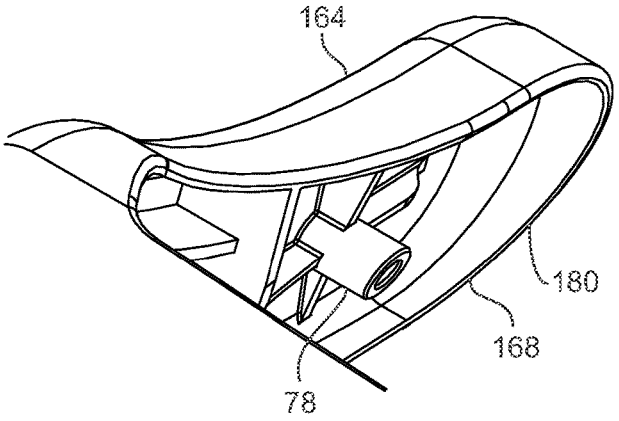
FIG. 11B is a detail perspective view of the distal end of the right hand arm of the tray apparatus of FIG. 1.
Figure 11C:
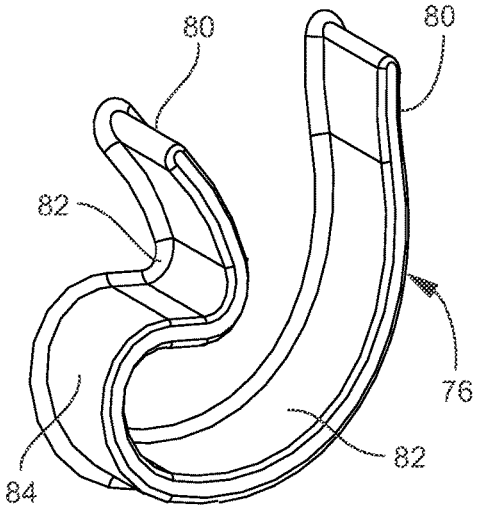
FIG. 11C is a detail perspective view of the left side ear of the left side of the base of FIG. 1, which ear engages the distal end of the left hand arm of the tray apparatus of FIG. 1.

As shown in FIGS. 1, 2 and 11C, each of the right and left sides 22, 24 of the outer wall 18 includes an ear 76 that interacts with a cylindrical pivot pin 78 of the tray apparatus 16. Ear 76 is a ridge that extends outwardly from the outer wall 18. Ear 76 includes a guide region defined by two opposing ridge ends 80 that are spaced apart from each other and flared relative to each other. Ear 76 tapers from the flared ridge ends 80 to a narrowed snapping region defined by opposing ridge sections 82. Ear 76 then widens out to a retaining pivoting region defined by an intermediate curved ridge section 84. Pivot pin 78 is guided into the ear 76 by the guide region, and then snapped into the retaining pivoting region where the pivot pin 78 is permitted to pivot. The distance between opposing ridge sections 82 is slightly less than the diameter of the pivot pin 78 to provide a snapping function and to retain the pivot pin 78 in the retaining pivoting region yet permit relatively easy engagement and easy disengagement of the pivot pin 78 with and from the ear 76 through the opposing snapping ridge sections 82. The retaining pivoting region is forwardly placed relative to the snapping region. The ear 76 is disposed below straight portions 62 of the integral upper junction 42.

As shown in FIG. 2, outer wall 18 further includes handles 86. One handle 86 is disposed on the right side portion 22 of the outer wall 18 and one handle 86 is disposed on the left side portion 24 of the outer wall 18. Each of the handles 86 undulates into the outer wall 18. Each of the handles 86 includes an inverted U-shaped transition surface 88 that leads from the conical portion of the outer wall 18 to an inner portion 90 of handle. Inner portion 90 is concave relative to an exterior of the floor seat apparatus 10. Transition surface 88 is convex relative to an exterior of the floor seat apparatus 10. Inner portion 90 is bounded by the inverted U-shaped surface 88 and the lower peripheral edge 28. Each of the inverted U-shaped surface 88 and the inner portion 90 includes the lower peripheral edge 28. Lower peripheral edge 28 defines a circle except for the portions of the handle 86 that include the lower peripheral edge 28. The portions of the handle 86 that include the lower peripheral edge 28 lie within such defined circle. Outer wall 18 defines a conical shape except for the handles 86 that are part of the outer wall, which handles 86 lie within such a conical shape.

Figure 9:
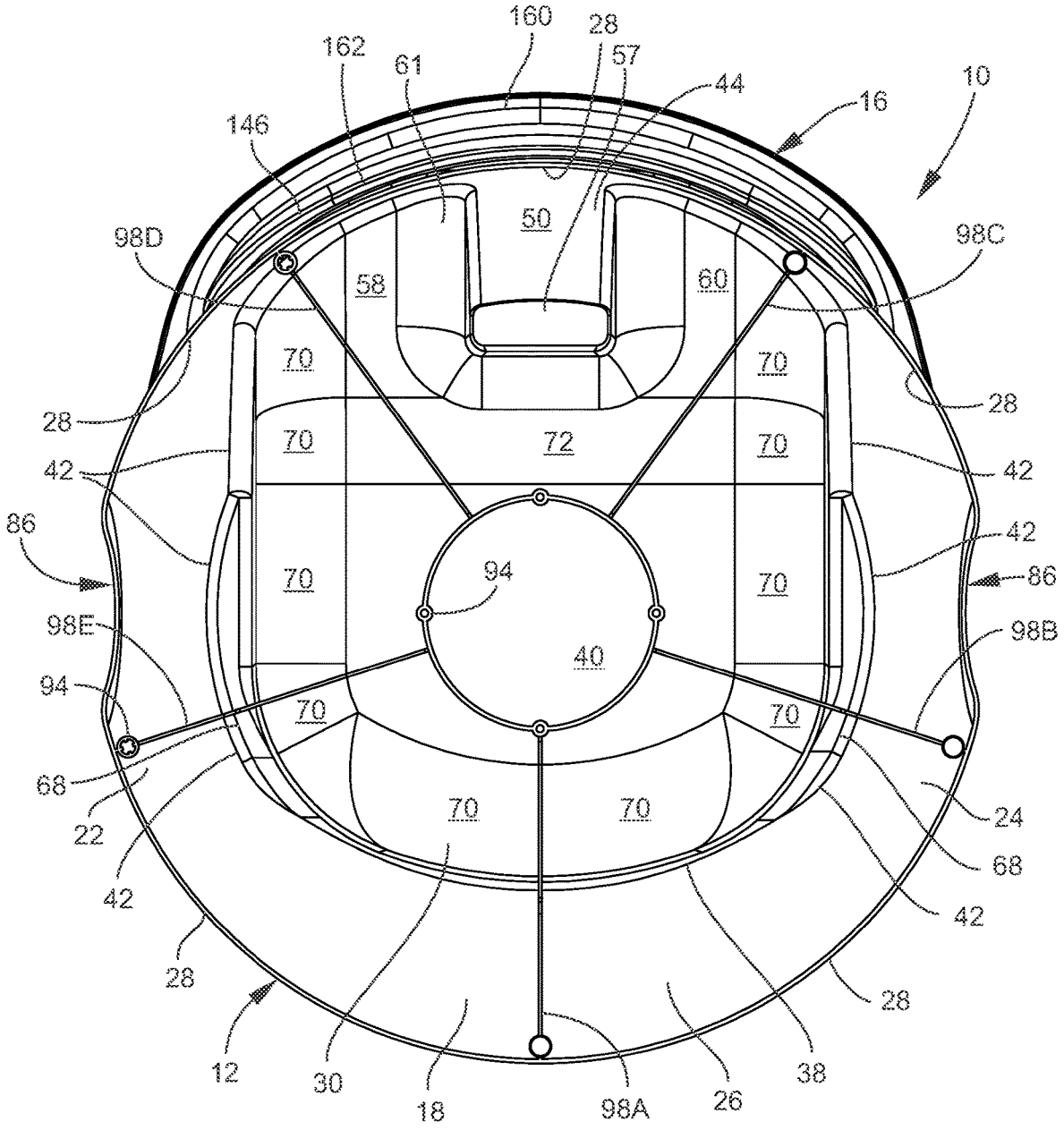
FIG. 9 is a bottom plan view of the floor seat apparatus of FIG. 4.

As shown in FIGS. 9 and 10, the outer wall 18 of the base 12 is spaced apart from the inner wall 30 of the base 12. To minimize flexing of the inner wall 30 and base bottom 40 when a child sits in the floor seat apparatus 10, an endless circular ridge 92 depends integrally from the undersurface of the base bottom 40. The bottommost edge of the endless circular ridge 92 is coplanar with the lower peripheral edge 28 of the outer wall 18.

Endless circular ridge 92 includes a set of four relatively small cylindrical pin receivers 94 that can engage rubberized or elastomeric or resilient or nonskid feet 96, which feet 96 rest on the surface upon which the floor seat apparatus 10 as a whole rests. Such surface may be cement, wood, carpet, rug, textile, grass, asphalt, dirt, gravel, ceramic, tile, brick, stone or other surface.

Radiating integrally from the endless circular ridge 92 are radial ribs 98A, 98B, 98C, 98D and 98E. Radial rib 98A is integral with and traverses base bottom 40, curved elongate section 70, back portion 38, integral upper junction 42 and the back portion 26 of outer wall 18. Radial rib 98B is integral with and traverses base bottom 40, curved elongate section 70, transition surface 68 of left side portion 36 of inner wall 30, integral upper junction 42 and left side portion 24 of outer wall 18. Radial rib 98C is integral with and traverses base bottom 40, transverse inclined surface 72, left ramp 60 and curved elongate surface 70. Radial rib 98D is integral with and traverses base bottom 40, transverse inclined surface 72, left ramp 58 and curved elongate surface 70. Radial rib 98E is integral with and traverses base bottom 40, curved elongate section 70, transition surface 68 of right side portion 34 of inner wall 30, integral upper junction 42 and right side portion 22 of outer wall 18.

Each of the distal ends of the radial ribs 98A, 98B, 98C, 98D and 98E includes a relatively large cylindrical receiver 94 that can engage rubberized or elastomeric or resilient or nonskid feet 96, which feet 96 rest on the surface upon which the floor seat apparatus 10 as a whole rests. Such surface may be cement, wood, carpet, rug, textile, grass, asphalt, dirt, gravel, ceramic, tile, brick, stone or other surface. Relatively large cylindrical receivers 94 are oriented conically and integrally engage in a tangential manner the inner surface of the outer wall 18.

When feet 96 are employed, lower peripheral edge 28 and the bottommost portion of the circular endless ridge 92 are spaced from the surface on which the floor seat apparatus 10 rests. When feet 96 are not employed, the lower peripheral edge 28 and the bottommost portion of the circular endless ridge 92 directly engage the surface. Where the surface is giving, such as where the surface is grass or dirt or carpet or rug, each of the feet 96, lower peripheral edge 28, and bottommost portion of the circular endless ridge 92 may directly engage such a surface.

Each of the ribs 98A, 98B, 98C, 98D and 98E can be defined as having integral rib portions, with one integral rib portion being on the outer wall 18, another integral rib portion being on the inner wall 30, another integral rib portion being on the base bottom 40, another integral rib portion being on and crossing the integral upper junction 42, and so on. In such a case, the integral rib portions are integrally joined end to end and the integral rib portions are coplanar with each other from the lower peripheral edge 28 to the endless circular ridge 92.

Each of the integral ribs 98A, 98B, 98C, 98D and 98E is spaced apart from the other ribs 98A, 98B, 98C, 98D and 98E.

Each of the integral ribs 98A, 98B, 98C, 98D and 98E defines a plane and such planes intersect at the center of the endless circular ridge 92 and at a central portion of the base bottom 40.

Each of the integral ribs 98A, 98B, 98C, 98D and 98E has a proximal end disposed at the lower peripheral edge 28 and a distal end disposed at the endless circular ridge 92.

Figure 3:
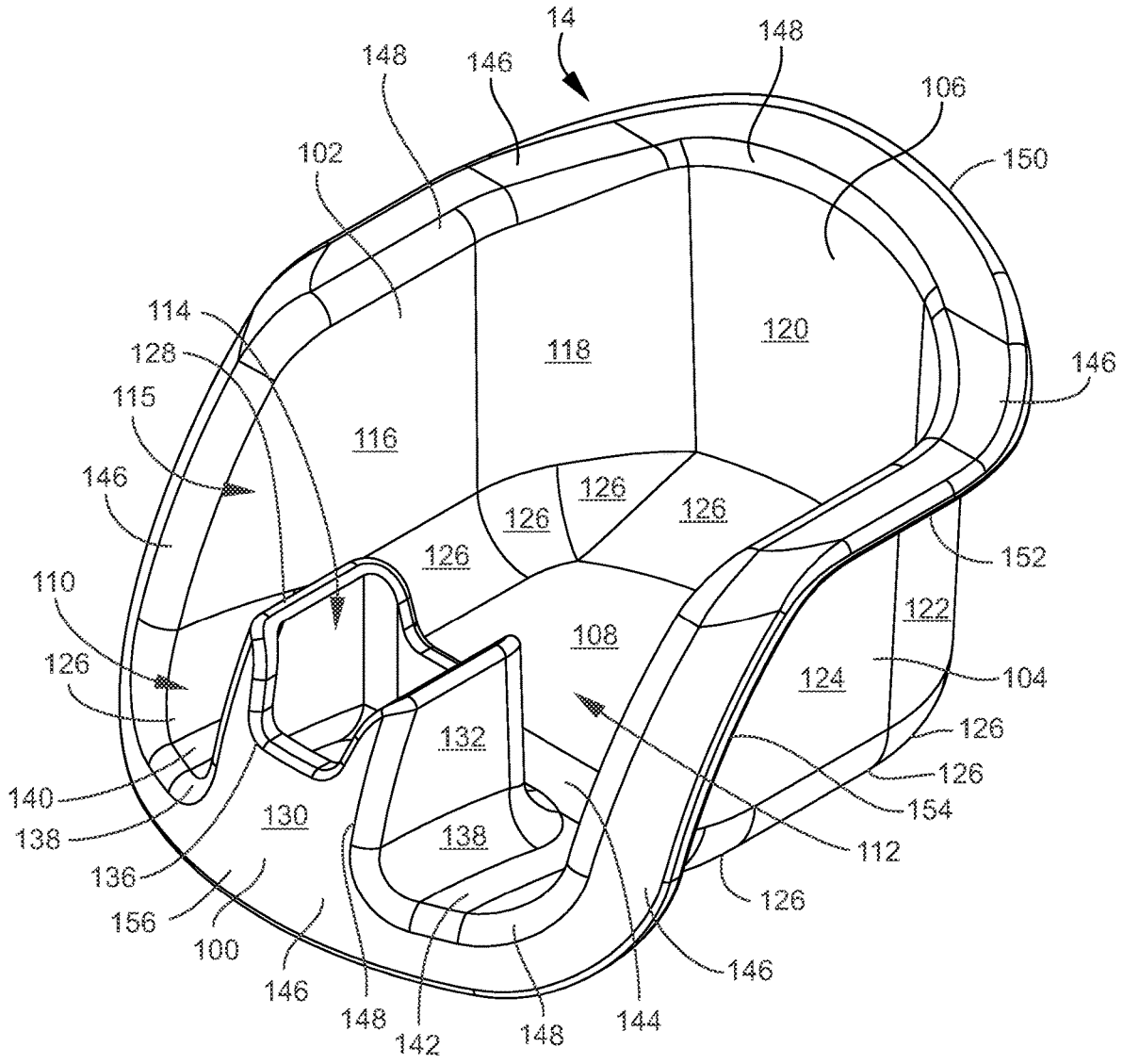
FIG. 3 is a perspective isolated view of the seat of the floor seat apparatus of FIG. 1.
Figure 4:
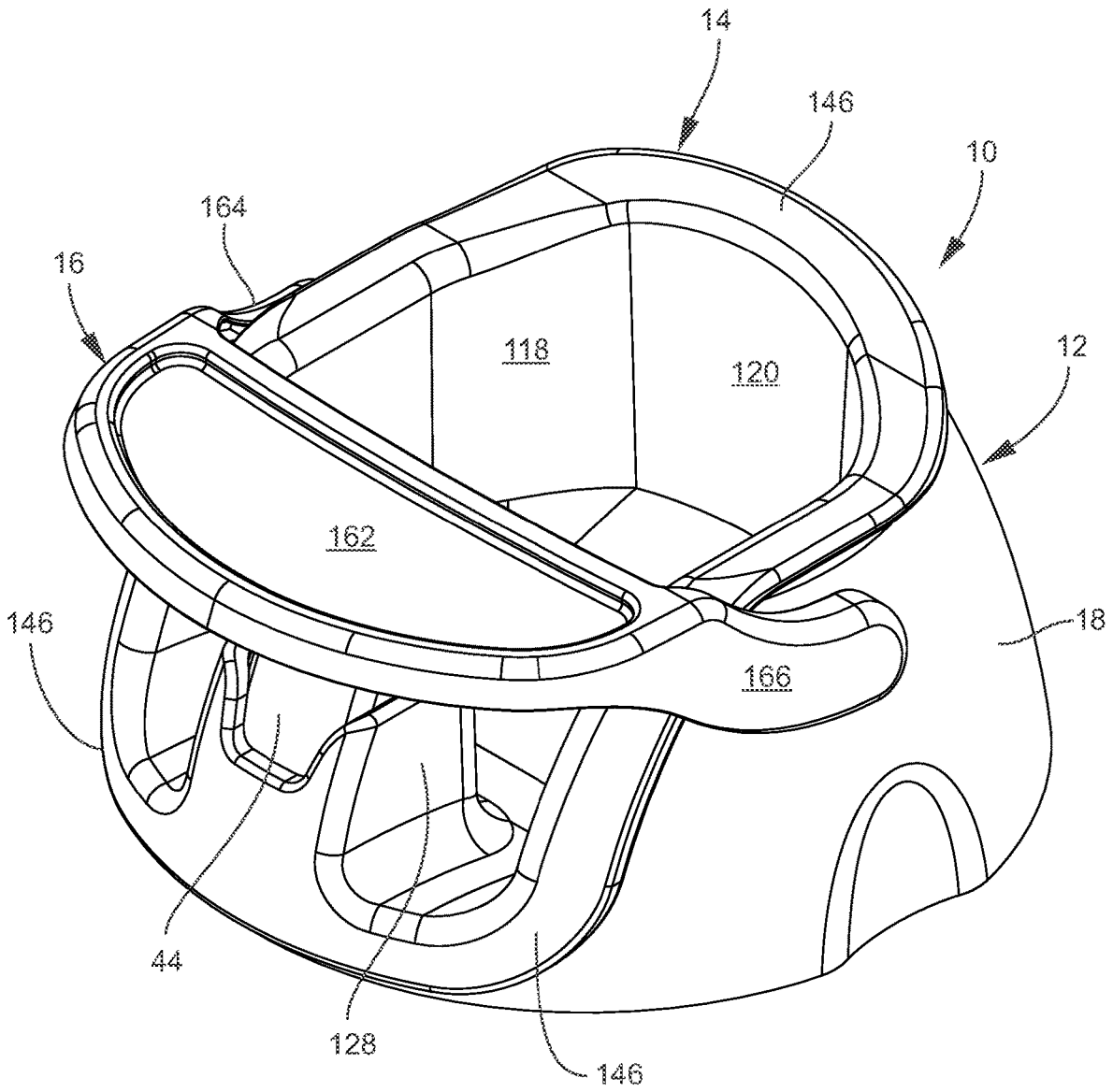
FIG. 4 is a perspective view of the floor seat apparatus of FIG. 1 where the seat is seated in the base and the tray apparatus is engaged to the base and engaged to the post of the base.

Seat 14 is shown in FIG. 3. Seat 14 is a child receptacle in that seat 14 directly engages the child in the floor seat apparatus 10, though the floor seat apparatus 10 may be used without the seat 14 such as when the child grows too large for the seat 14 but still fits comfortably in the base 12 having no seat 14.

As shown in FIG. 3, seat 14 includes an integral front wall 100, an integral right side wall 102, an integral left side wall 104, an integral back wall 106, and an integral seat bottom 108. A front portion of the seat 14 further includes a right side U-shaped leg receptor 110, a left side U-shaped leg receptor 112, and a post through opening 114 disposed between the right and left side leg receptors 110, 112. The post through opening 114 receives the post 44 of the base 12.

Seat 14 includes a U-shaped portion 115 made up of vertically running sections 116, 118, 120, 122, and 124. U-shaped portion 115 is disposed at a generally right angle relative to a plane defined by lower peripheral edge 28 of base 12 when seat 14 is engaged in base 12. Right side wall 102 includes sections 116, 118. Back wall 106 includes section 120. Left side wall 104 includes sections 122, 124. Section 118 is a curved transition section between section 116 and section 120. Section 122 is a curved transition section between section 120 and section 124. Sections 118, 120 and 122 are concave relative to an interior of seat 14. U-shaped portion 115 is adjacent to, confronts, conforms with, is complementary to, and makes direct contact with the following sequential portions of the base 12: vertical section 66 of the right side portion 22, vertical section 68 of the right side portion 22, back portion 38, vertical section 68 of the left side portion 24, and vertical section 66 of the left side portion 24.

Seat bottom 108 defines a plane that is parallel to a plane defined by the lower peripheral edge 28 of base 12 when seat 14 is engaged in base 12. Seat bottom 108 is adjacent to, confronts, conforms with, is complementary to, and makes direct contact with base bottom 40.

Seat 14 includes a curved elongate U-shaped portion 126. Curved elongate U-shaped portion 126 is disposed between the U-shaped vertical portion 115 and the seat bottom 108. Curved elongate U-shaped portion 126 is a transition surface from the U-shaped vertical portion 115 to the seat bottom 108. Curved elongate U-shaped portion 126 runs from the right side leg receptor 110 to the left side leg receptor 112. Curved elongate U-shaped portion 126 is a concave surface relative to an interior of the seat 12 where the child sits in the floor seat apparatus 10. Curved elongate U-shaped portion 126 is adjacent to, confronts, conforms with, is complementary to, and makes direct contact with curved elongate U-shaped section 70 of base 12.

Post through opening 114 is formed by a post receptor 128. Post receptor 128 includes a front wall 130, a pair of opposing side walls 132, and a rear wall 134. Each of the front wall 130 and rear wall 134 includes a U-shaped upper edge 136. Each of the side walls 132 includes a straight upper edge. Post receptor 128 is adjacent to, confronts, conforms with, is complementary to, and makes direct contact with post 44.

Post receptor 128 includes a post receptor base 138 that surrounds three sides of the post receptor 128, namely, side walls 132 and rear wall 134. Post receptor base 138 is concave relative to an interior of the seat 12. Post receptor base 138 runs from the right side leg receptor 110 to the left side leg receptor 112. Post receptor base 138 is adjacent to, confronts, conforms with, is complementary to, and makes direct contact with post base 61 of base 12.

Seat 14 includes a right side ramp 140 and a left side ramp 142. Ramps 140 extend from an interior of the seat 12 to an exterior of the seat 12. Ramp 140 is disposed between post receptor base 138 and U-shaped portion 126 on the right side of the seat 12. Ramp 142 is disposed between the post receptor base 138 and U-shaped portion 126 on the left side of the seat 12. Right side ramp 140 extends through and partially defines the right side leg receptor 110. Left side ramp 142 extends through and partially defines the left side leg receptor 110. Each of the longitudinal ramps 140, 142 is integral with a transversely extending ramp 144. Transversely extending ramp 144 is disposed between the distal ends of ramps 140, 142 and seat bottom 108. Transversely extending ramp 144 is further disposed between the post receptor base 138 and the seat bottom 108. Ramps 140, 142 have a steeper incline than does ramp 144. Ramps 140, 142 are adjacent to, confront, conform with, are complementary to, and make direct contact with ramps 58, 60, respectively, of base 12. Ramp 144 is adjacent to, confronts, conforms with, is complementary to, and makes direct contact with ramp 72 of base 12.

Seat 12 includes a peripheral lip 146 that runs about the entirety of the seat 12. An integral upper junction 148 is disposed between peripheral lip 146 and the following sequential portions of the seat 12: the right side end of U-shaped section 138, the outer end of ramp 140, the right side end of U-shaped section 126, section 116, section 118, section 120, section 122, section 124, the left side end of U-shaped section 126, the outer end of ramp 142, the left side end of U-shaped section 138. Integral upper junction 148 can further be defined to include the junction portion between right hand post receptor wall 132 and post receptor front wall 130 and the junction portion between left hand post receptor wall 132 and post receptor front wall 130. Integral upper junction 148 of seal 14 is adjacent to, confronts, conforms with, is complementary to, and makes direct contact with integral upper junction 42 except for the portion of integral upper junction 42 that extends above the post receptor 128.

Peripheral lip 146 extends outwardly beyond integral upper junction 42 of the base 12 when the seat 14 is engaged with and seated in base 12. Peripheral lip 146 includes a back or neck confronting portion 150, right hand side and left hand side straight horizontal portions 152 that oppose each other, oblique portions 154 that oppose each other, and a lower portion 156.

Seat 14, molded from a softer or more resilient or less hard plastic than the plastic that the base 12 is molded from, isolates the child in the seat from the relative hard base 12. For example, the relatively soft or resilient peripheral lip 146 keeps the child from hitting the relatively hard integral upper junction 42 of the base 12 when the child climbs into and out of the floor seat apparatus 10. Further, the relatively soft or resilient post receptor 128 protects the legs, groin and torso from harm by the relatively hard post 44. Still further, the relatively soft or resilient back or neck confronting portion 150 of the peripheral lip 146 protects the neck and head of the small child from the hard back or neck confronting portion 64 of the base 12 when the child tosses his or her head back or slips downwardly and forwardly into the floor seat apparatus 10. Also, the straight horizontal portion 152 of the relatively soft peripheral lip 146 protects the funny bone of the elbow of the child from the relatively hard straight horizontal portions 62 of the integral upper junction 42.

Figure 5:
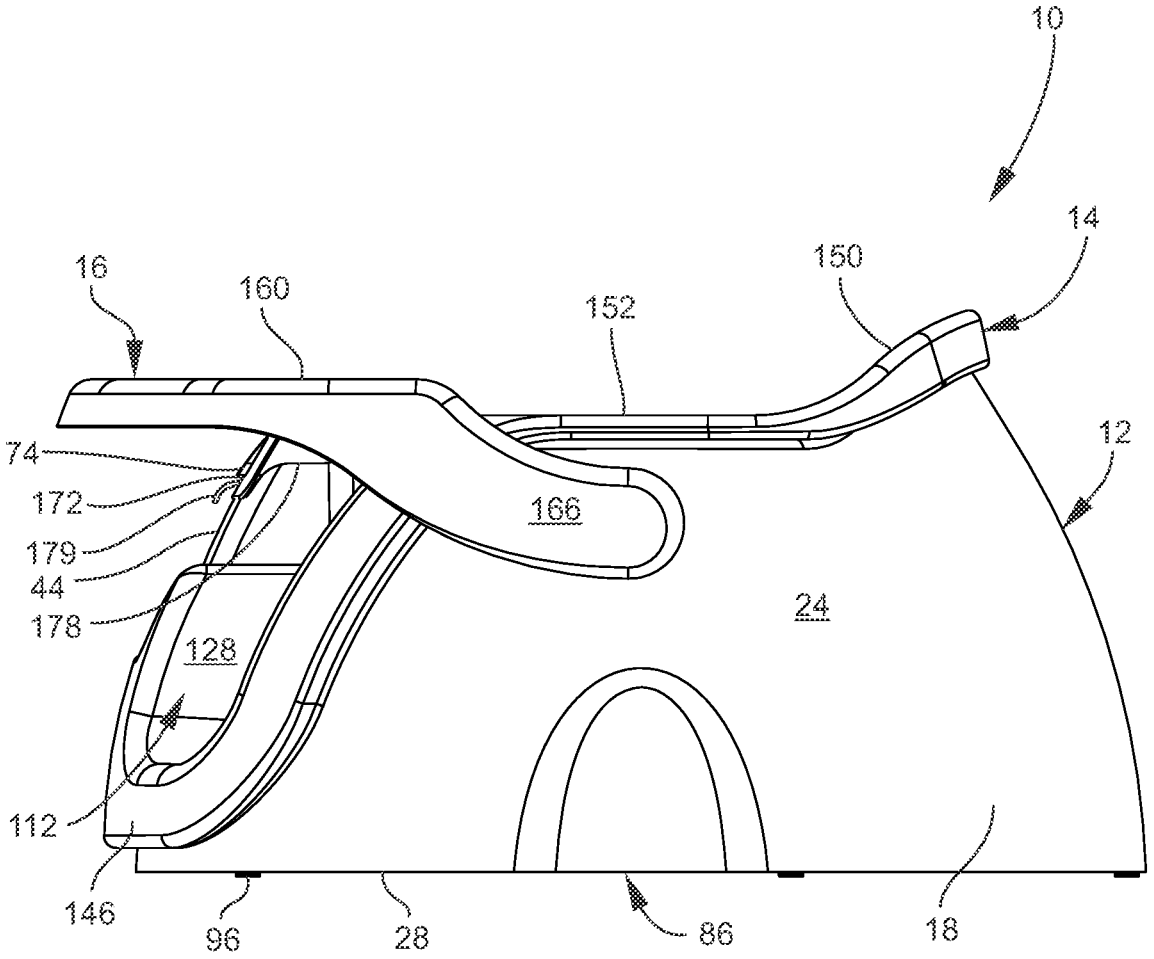
FIG. 5 is a left side elevation view of the floor seat apparatus of FIG. 4.
Figure 6:
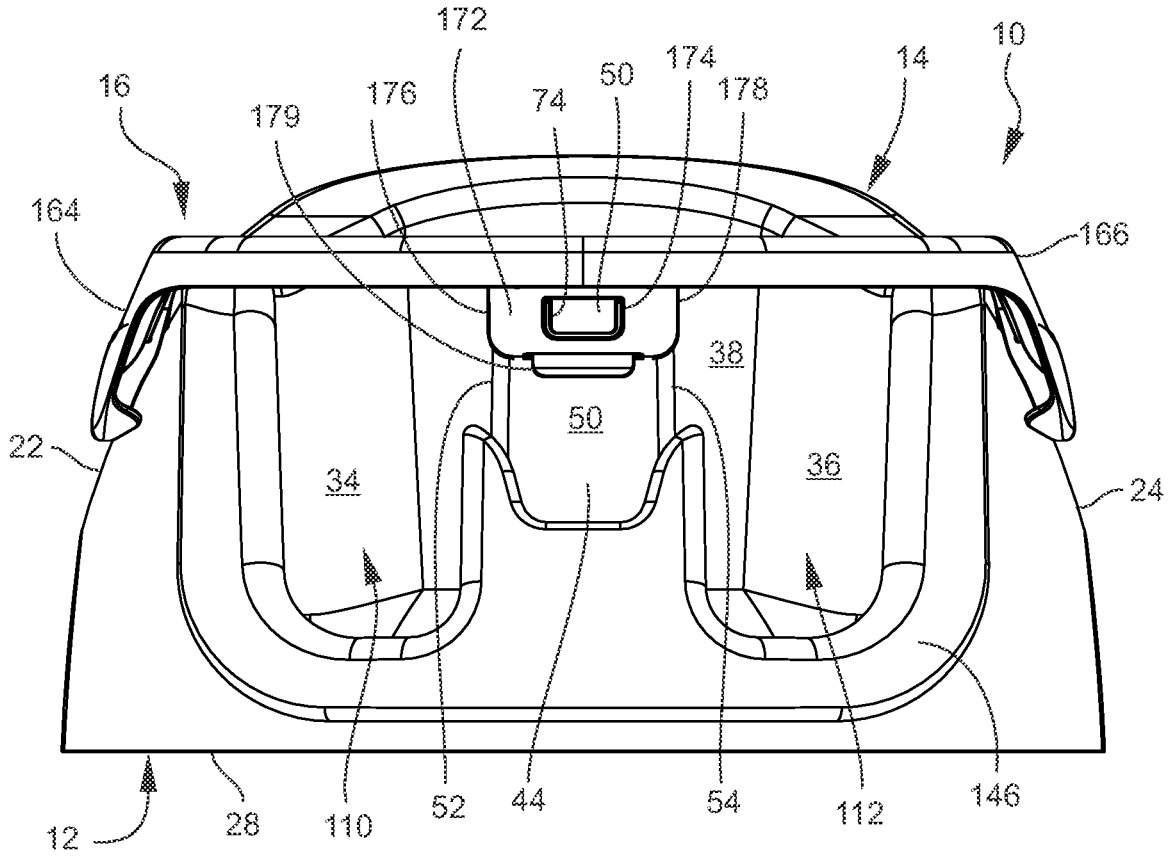
FIG. 6 is a front elevation view of the floor seat apparatus of FIG. 4.

Tray apparatus is shown in FIGS. 1, 4, 5, 6, 7, 8, 9, 10, 11A and 11B. Tray apparatus 16 includes a tray 158 that in turn includes a rim 160 surrounding a sunken flat, smooth, planar eating area 162. Tray apparatus 16 further includes a right arm 164 and a left arm 166. Each of the arms 164, 166 includes a distal end 168. Each of the distal ends 168 includes the pivot pin 78 that interacts with the ear 76. Base 12 includes a right side ear 76 and a left side ear 76. Tray apparatus 16 further includes a U-shaped post retainer 170 that includes a front depending wall 172 with a window 174 and that further includes a right side depending wall 176 and a left side depending wall 178. As shown in FIGS. 5, 6 and 11A, U-shaped post retainer 170 further includes an elongate curled tab 179 projecting forwardly and downwardly from the bottom edge of front depending wall 172. Tab 179 may be engaged by a finger to lift up and pivot up the tray apparatus 16 away from the post 44 or to draw down and pivot down the tray apparatus 16 so as to connect it to the post 44. When the U-shaped post retainer 170 is engaged to the U-shaped ridge 74 on the post 44, front depending wall 172 is not spaced from the post 44, but the frontwardly and downwardly projecting curled tab 179 is spaced from the post 44 to make it easy for a finger to engage the tab 179. U-shaped post retainer 170 depends from an undersurface of tray flat portion 162. The post upper elongate edge 57 abuts, is adjacent to, and confronts the undersurface of tray flat portion 162. The post upper elongate edge 57 and the pivot pins 78 support the weight of the tray apparatus 16 relative to the base 12. Right and left side walls 176, 178 limit transverse or side to side movement of the tray apparatus 16 relative to the post 44. The interaction between U-shaped ridge 74 and the edges of front wall 172 that form window 174 limit vertical or up and down movement of the tray apparatus 16 relative to the post 44. When the tray apparatus 16 is moved forwardly and upwardly in the retaining region of ear 76 without disengaging pivot pin 78 from the retaining region of ear 76, the window 174 and front wall 172 disengage from the U-shaped ridge 74 and permits the tray apparatus 16 to be swung up and over the head of a child in the floor seat apparatus 10 while keeping the tray apparatus 16 engaged to the base 12. When the tray apparatus 16 as a whole is moved rearwardly in the ear 76 from the retaining region of the ear 76 and to and through the snapping region of the ear 76, the tray apparatus 16 can be removed from the base 12 while the child is in the floor seat apparatus 10.

In operation, when the seat 14 is to be used, the seat 14 is placed on the base 12 from above. The post 44 is inserted into the post through opening 114 from below. The seat 14 continues to be inserted into the seat receptacle of the base 12 until the underside of the seat bottom 108 makes contact with the base bottom 40. When the seat bottom 108 rests on the base bottom 40, the peripheral lip 146 of the seat 14 runs adjacent to the integral upper junction 42 of the base 12 except for the portion of the integral upper junction 42 that extends above the post receptor 128 of the seat 14. As indicated above, when the seat 14 is engaged with the base 12: a) U-shaped portion 115 is adjacent to, confronts, conforms with, is complementary to, and makes direct contact with the following sequential portions of the base 12: vertical section 66 of the right side portion 22, vertical section 68 of the right side portion 22, back portion 38, vertical section 68 of the left side portion 24, and vertical section 66 of the left side portion 24; b) Seat bottom 108 of the seat 14 is adjacent to, confronts, conforms with, is complementary to, and makes direct contact with base bottom 40 of the base 12; c) Curved elongate U-shaped portion 126 of the seat 14 is adjacent to, confronts, conforms with, is complementary to, and makes direct contact with curved elongate U-shaped section 70 of base 12; d) Post receptor 128 of the seat 14 is adjacent to, confronts, conforms with, is complementary to, and makes direct contact with post 44 of the base 12; e) Post receptor base 138 is adjacent to, confronts, conforms with, is complementary to, and makes direct contact with post base 61 of base 12; f) Ramps 140, 142 are adjacent to, confront, conform with, are complementary to, and make direct contact with ramps 58, 60, respectively, of base 12; g) Ramp 144 is adjacent to, confronts, conforms with, is complementary to, and makes direct contact with ramp 72 of base 12; and h) Integral upper junction 148 of seal 14 is adjacent to, confronts, conforms with, is complementary to, and makes direct contact with integral upper junction 42 except for the portion of integral upper junction 42 that extends above the post receptor 128. In other words, when the seat 14 is engaged with the base 12, the seat 14 does not spin, slip, or move forwardly, rearwardly, to the left, or to the right, or move obliquely in some fashion. Another feature contributing to the nonspin of the seat 14 relative to the base 12 is that the post 44 has four sides and that the post receptor 128 has four sides and that at and adjacent to the bases of the post receptor 128 and post 44, the length and width of the post through opening 114 is about equal to or slightly less than the length and width of the post 44.

After the seat 14 is engaged in the base 12, the child is placed into the seat 14. When the child is in the seat 14, the relatively soft peripheral lip 144 protects the child from falling against portions of the relatively hard base 12.

When the child is in the seat 14, the buttocks of the child rests on the seat bottom 108. The legs of the child extend through the right and left side leg receptors 110, 112. The underside of portions of the legs, such as the underside of the thighs or back of the knees, may rest upon the ramps 140, 142 and 144. Bottom 108 is disposed at a lower elevation than ramp 144 and ramp 144 is disposed at a lower elevation than ramps 140, 142 when the seat 14 is engaged in the base 12 and when the lower peripheral edge 28 is disposed on a horizontal surface. The back of the child may rest against back curved section 120 of the seat 14. Forearms and elbows of the child may rest on one or more portions of the peripheral lip 146 and integral upper junction 148 such as horizontal straight portions 152. The neck of the child may rest upon the semicircular back or neck confronting portion 150 of the peripheral lip 146.

In operation, the tray apparatus 16 may or may not be used. If the tray apparatus 16 is to be used, the pivot pins 78 are placed into the guide regions of the ears 76 and the tray apparatus 16 is pulled forwardly to pull the pivot pins 78 through the snapping regions of the ears 76 and into the retaining region of the ears 76, whereupon the tray 158 of the tray apparatus 16 can be swung downwardly to the top of the post 44, whereupon the U-shaped retaining ridge 74 snaps into the window 174 of the U-shaped retainer 170.

To swing the tray apparatus 16 to an out-of-the-way position, such as where the child is picked up out of the floor seat apparatus 10, the tray apparatus 16 is pulled forwardly slightly to disengage the U-shaped retaining ridge 74 from the window 174 without disengaging the pivot pin 78 from the retaining pivoting region of the ear 76, and then the tray 158 is swung upwardly over the head of the child.

To remove the tray apparatus 16 from the base 12, the tray apparatus 16 is pulled forwardly slightly to disengage the U-shaped retaining ridge 74 from the window 174, and then the tray apparatus 16 is removed rearwardly to move the pivot pins 78 out of the retaining region of the ears 76, through the snapping region of the ears 76 and out of the guiding region of the ears 76 such that the pivot pins 78 are disengaged completely from the ears 76 and from the base 12.

A caregiver may then pick up the child out of the floor seat apparatus 10. The base 12 and seat 14 are sufficiently light in weight such that the caregiver can then carry the base 12 and seat 14, with or without the tray apparatus 16, to a storage area. The caregiver may or may not use the handles 86 when carrying the floor seat apparatus 10.

In the storage area, the base 12 and seat 14 combination, without the tray apparatus 16, is stackable. Features contributing to the stackability of the base 12 and seat 14 combination are a) the double wall construction of the base 12, where the outer wall 18 and inner wall 30 are spaced from each other, b) the general conical shape of the outer wall 18, and c) the hollow feature of the post 44 that permits the post 44 of another base 12 to be inserted therein.

As shown in FIGS. 5 and 6, the bottommost portion of the peripheral lip 146 of the seat 14 is spaced from and spaced above the lower peripheral edge 28 of the base 12.

As shown in FIG. 5, the forward most part of the tray apparatus 16 extends forwardly of the forward most part of the peripheral lip 146 of the seat 14.

As shown in FIG. 5, the rim 160 of the tray apparatus 16 is disposed in a plane adjacent to and spaced above a plane defined by the uppermost edges of straight horizontal portions 152 of the peripheral lip 146 when the tray apparatus 16 is engaged with the post 44.

Figure 7:
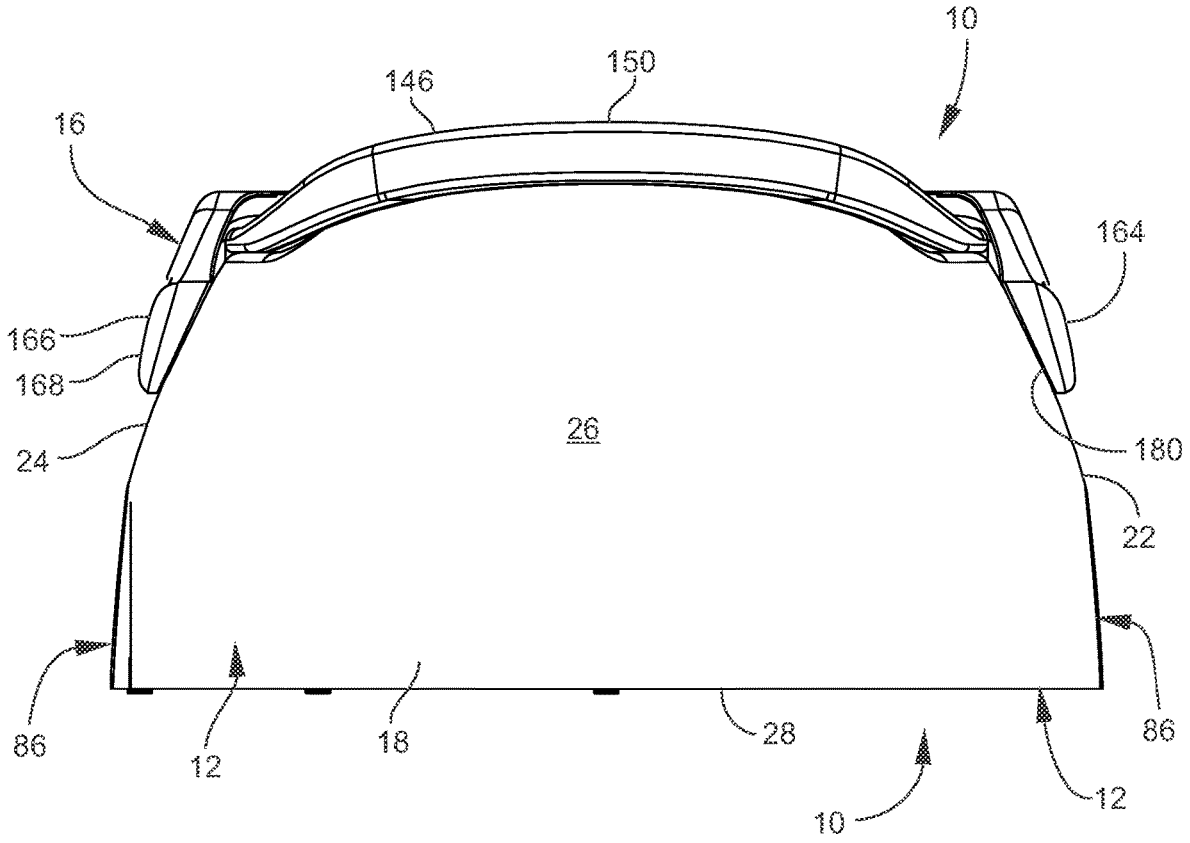
FIG. 7 is a rear elevation view of the floor seat apparatus of FIG. 4.

As shown in FIG. 7, each of the distal ends 168 of the right and left arms 164, 166 of the tray apparatus 16 may include an oblique inner face 180 to conform to the conical shape of the outer wall 18. Inner face 180 is oblique to the axis of the pivot pins 78 and to the plane defined by the lower peripheral edge 28 of the base 12. If desired, the oblique inner face 180 may be conical to even further conform to the contour of the outer wall 18.

As shown in FIG. 9, section 38 of the inner wall 30 may be disposed at a more true right angle to a plane defined by the lower peripheral edge 28 than are sections 68 of the right and left sides 34, 36 of the inner wall 30.

Figure 8:
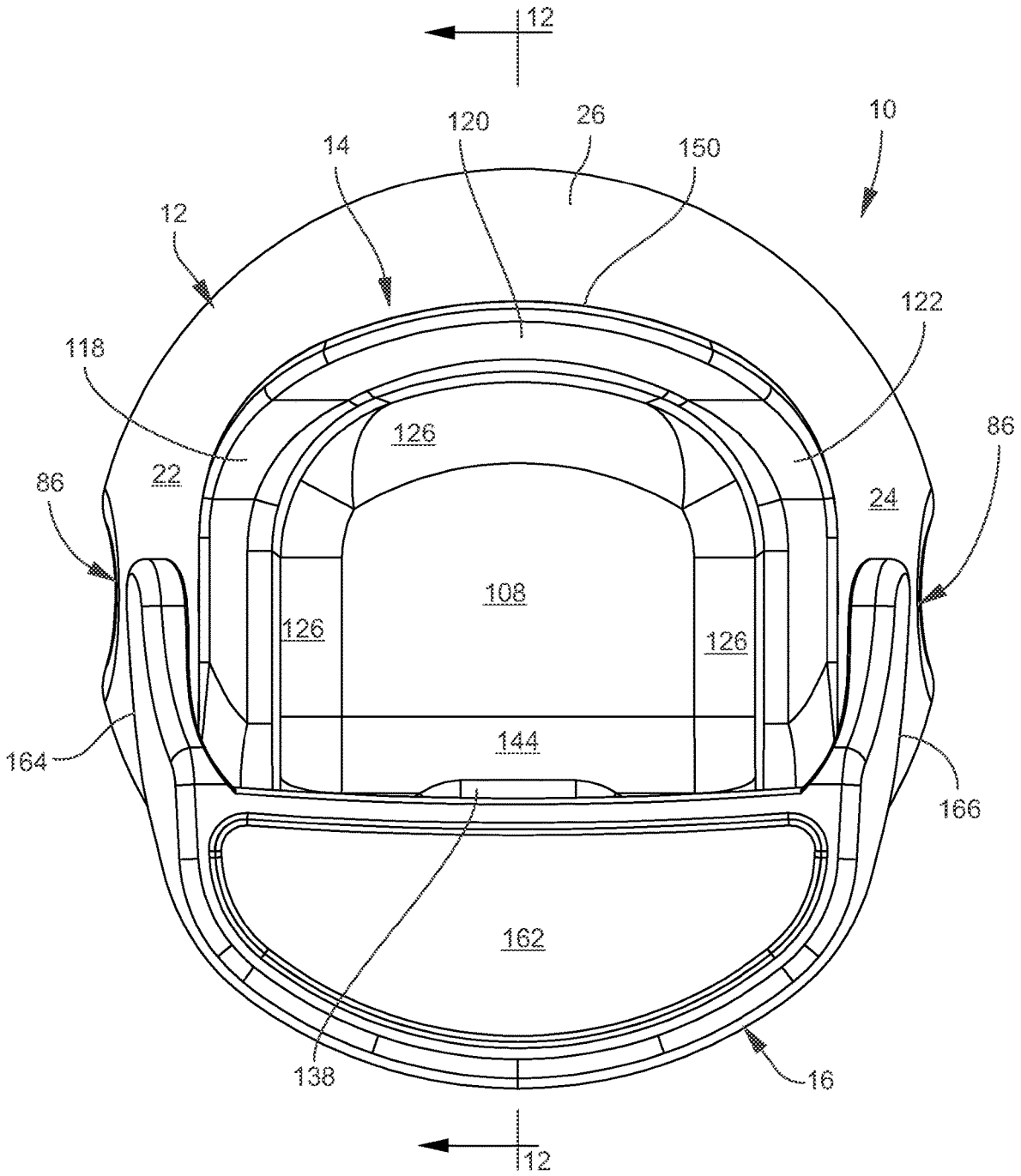
FIG. 8 is a top plan view of the floor seat apparatus of FIG. 4.
Figure 12:
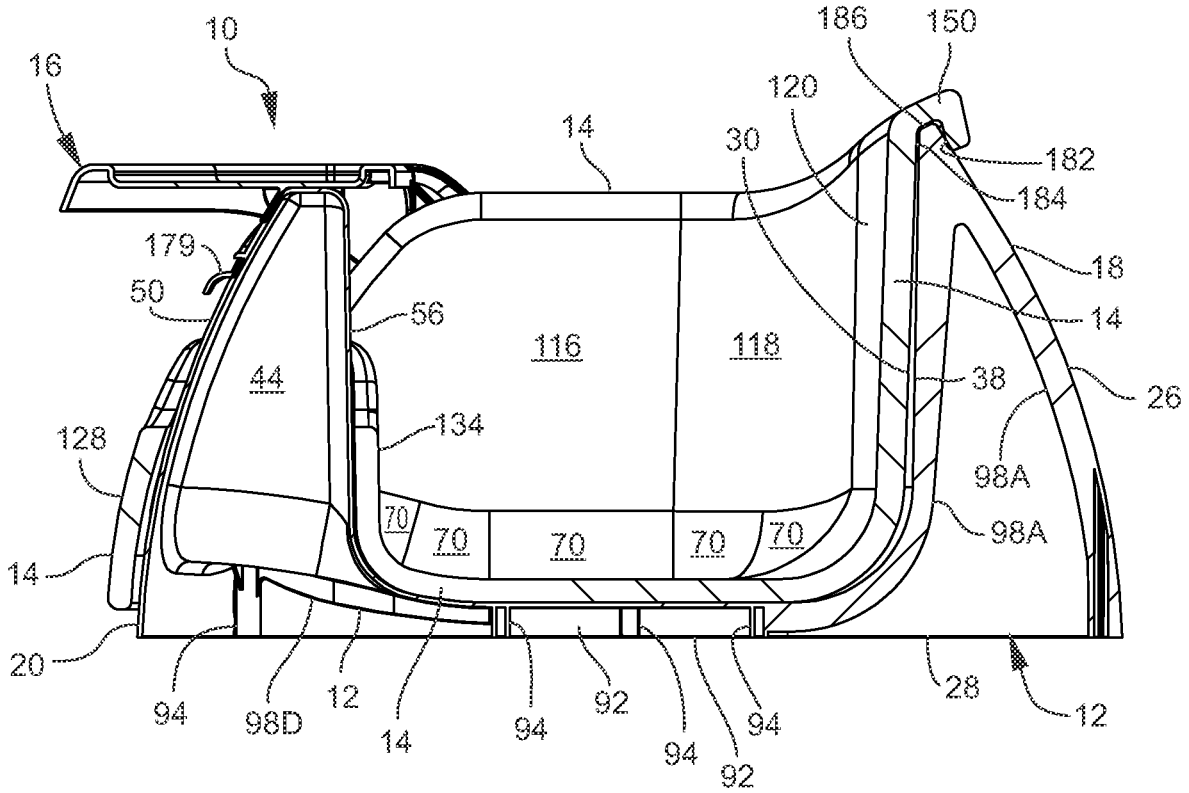
FIG. 12 is a section view at lines 12-12 of FIG. 8.

FIG. 12 shows a section view at lines 12-12 of FIG. 8. In particular, FIG. 12 show that the back or neck confronting portion 150 is U-shaped so as to squeeze the semi-circular junction portion 64 of the junction 42 that is formed by the inner wall 30 of the base 12 and the back portion 26 of the outer wall 18 of the base 12. The semi-circular junction portion 64 of the junction 42 runs between the straight junction portions 62 of the base 12, as shown in FIG. 2. Back or neck confronting portion 150 of seat 12 includes opposing faces 182, 184. Back or neck confronting portion 150 further includes a ceiling 186 running between faces 182, 184. Ceiling 186 and faces 182, 184 form a channel and this channel receives the semi-circular junction portion 64 of junction 42 from the end of the right straight junction portion 62 to the end of the left straight junction portion 62. This channel becomes progressively deeper as the semi-circular junction portion 64 rises in elevation. U-shaped back or neck confronting portion 150 is resilient. When seat 14 is not engaged to and is free of the base 12, faces 182, 184 may touch each other or confront each other very closely. When seat 14 is on the base 12, faces 182, 184 resiliently clamp to the semi-circular junction portion 64 of the base 12 to minimize movement of the seat 14 in the base 12.

When an infant sits on seat 14 or seat insert 14, seat 14 is depressed in a resilient manner. Seat 14 may be formed of a closed or open cell or another resilient plastic material that springs back after being depressed under the weight of an infant or after being depressed by a hand. Base 12, after being formed by injection molding or compression molding, is relatively rigid and at the same time somewhat flexible. Each of the outer wall 18 of the base 12, inner wall 30 of base 12, base bottom 40, post 44 and other wall or wall like sections of the base 12 may be in a plate like or sheet like form.

The base 12 may be made from a relatively hard plastic like polypropylene. Base 12 may be injection molded or include injection molded portions. Some features contributing to the rigidity of base 12 are ribs 98A, 98B, 98C, 98D 98E and circular ridge or rib 92.

The wall thickness of each of the outer wall 18 of the base 12, inner wall 30 of base 12, base bottom 40, and post 44 and other wall or wall like sections of the base 12 may be about 0.09 inches to about 0.10 inches.

The seat 14 or seat insert 14 may be formed from a relatively soft material 1) that may be a closed cell foam, 2) that is an elastic polymer material, 3) that is similar to rubber, 4) that is resistant to cracks, 5) that is resistant to ultraviolet radiation, 6) that has a high level of chemical cross linking, 7) that is semi-rigid, 8) that has a fine uniform cell structure, 9) that is a compliant material, 10) that may be either injection molded or compression molded, and 11) that can provide for a uniform wall thickness of about 8 mm for the seat 14 or seat insert 14. One such material that provides for or includes all such eleven features is ethylene vinyl acetate (EVA), which may include blended copolymers.

Figure 13A:
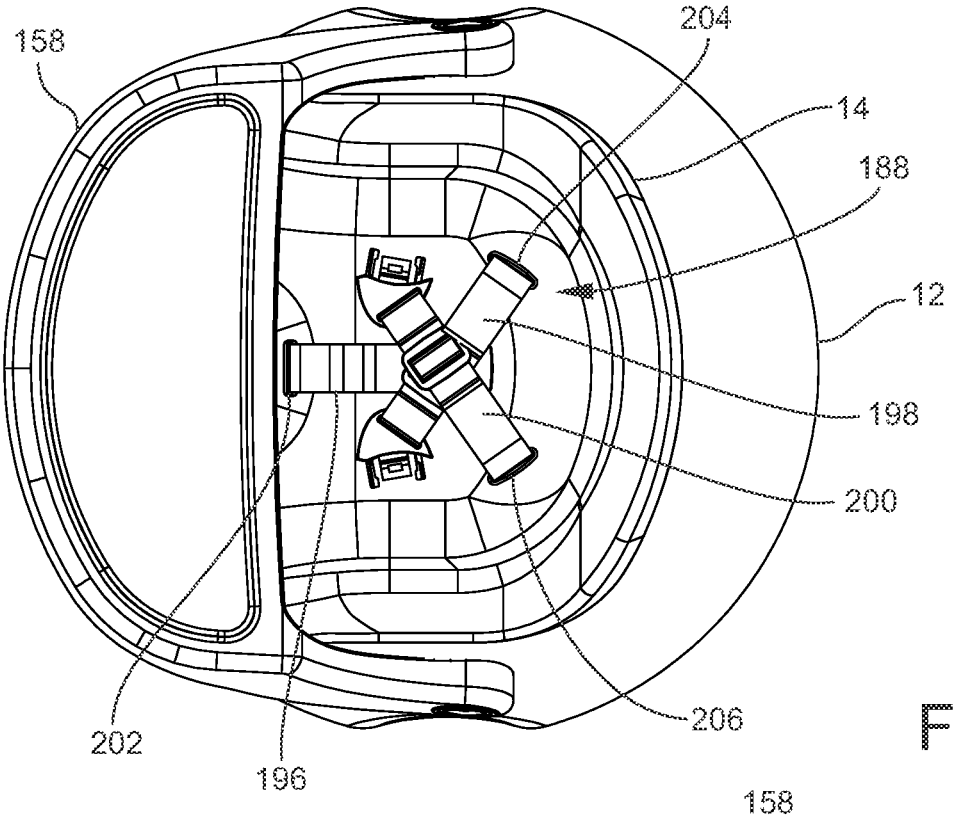
FIG. 13A is a top view of a view of the floor seat apparatus of FIG. 1A having a strap apparatus.

FIG. 13A shows a top view of the floor seat apparatus 10 of FIG. 1 but modified so as to include a strap apparatus 188. Strap apparatus 188, as shown in FIG. 14A, includes a female buckle portion 190, first and second male buckle portions 192, 194, a flexible strap 196 engaged to the female buckle portion 190, and first and second flexible straps 198, 200 engaged the first and second male buckle portions 192, 194, respectively.

Figure 13B:
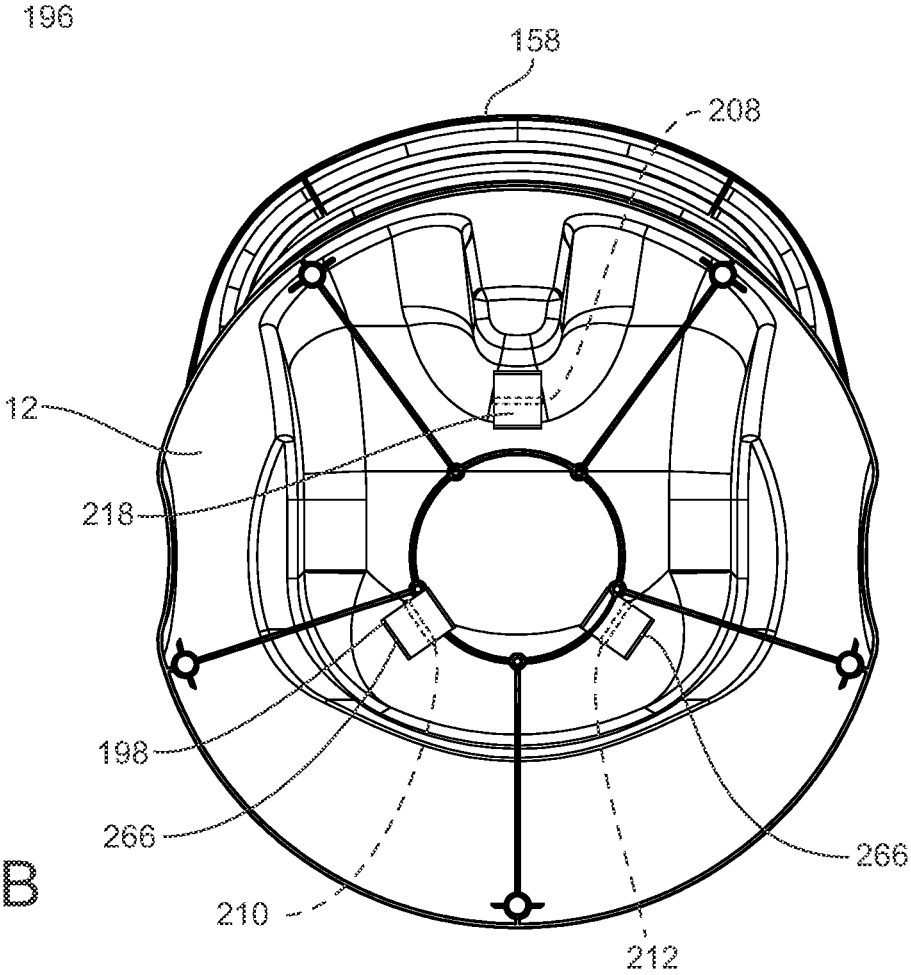
FIG. 13B is a bottom view of the floor seat apparatus of FIG. 13A.

FIG. 13A shows the seat 14 in the base 12. Seat 14 includes three slots 202, 204, 206 for the respective straps 196, 198, 200. Slot 202 is formed in the post receptor base 138 of the post receptor 128. Slots 204, 206 are formed in the U-shaped portion 126 between the seat bottom 108 and back section 120. Associated and aligned slots are formed in the base 12 such that a slot 208 associated and aligned with slot 202 is formed in post base 61 of base 12, and such that slots 210, 212 associated and aligned with respective slots 204, 206 are formed in the curved elongate surface 70 of the base 12 between the base bottom 40 and the back portion 38 of the base 12. Slots 208, 210, and 212 are shown in phantom in FIG. 13B.

Figure 14A:
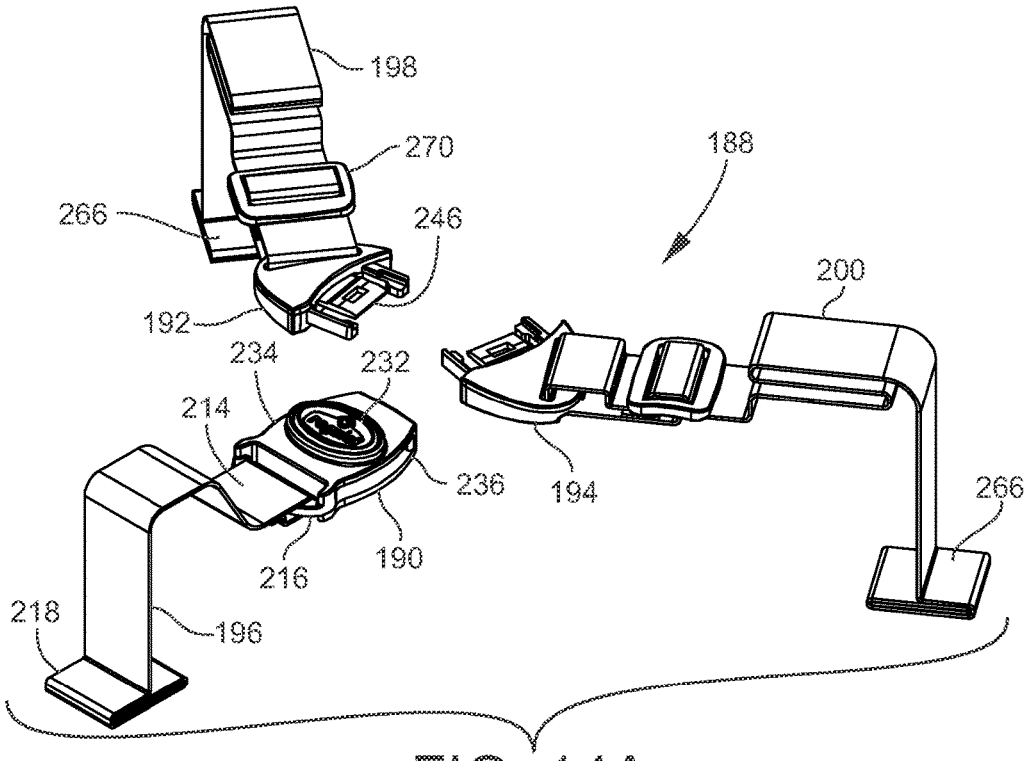
FIG. 14A is a perspective isolated view of the strap apparatus of FIG. 13A.
Figure 14B:
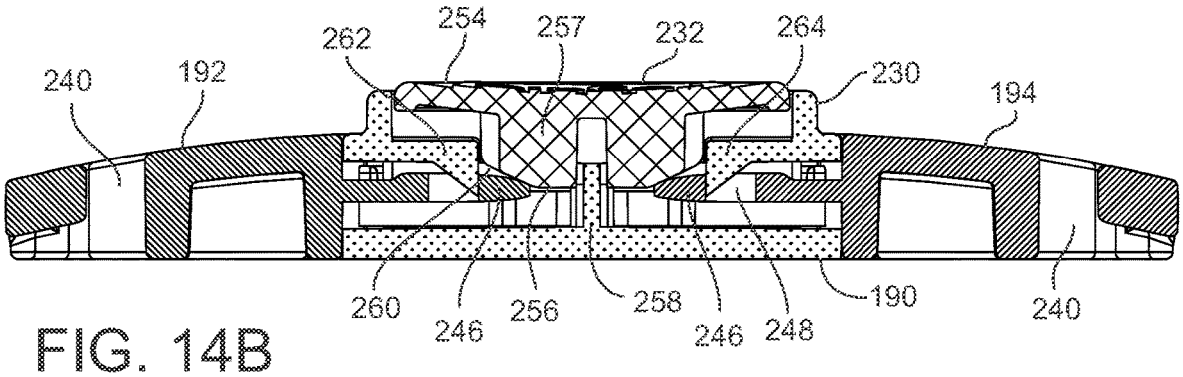
FIG. 14B is a lateral section view of a central portion of the strap apparatus of FIG. 14A in a buckled state.
Figure 14C:
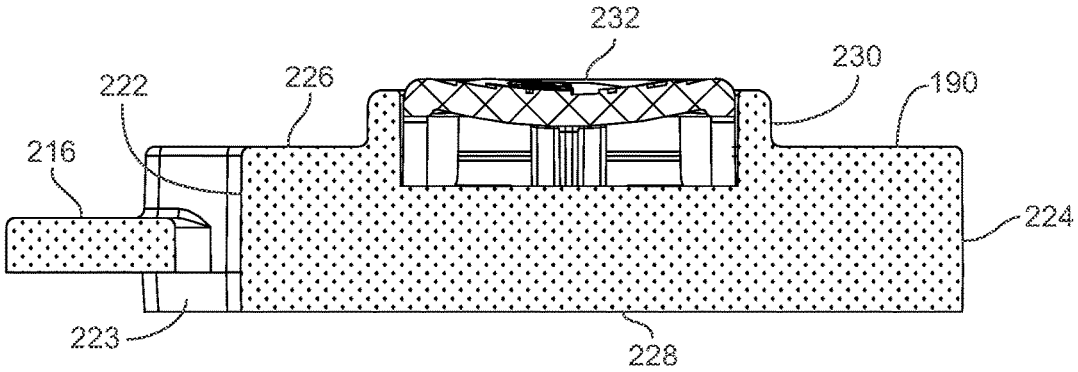
FIG. 14C is a longitudinal section view of a central portion of the strap apparatus of FIG. 14A in a buckled state.

Strap 196 is shown in FIG. 14A. Strap 196 includes a looped proximal end 214 engaging a post 216 of the female buckle portion 190 and a distal anchor end 218. Distal anchor end 218 includes three and one-half layers of fabric stitched together. Between the proximal end 214 and the distal end 218 is a main flexible strap portion 220. Distal end 218 engages the underside of the base 12 and prevents the strap 196 from being pulled through slots 208, 202 when the proximal faces of the distal end 218 engage the underside of the base 12 and when the distal end 218 is extending at a right angle to the main body strap portion 220. When the distal end 218 is pivoted to lay flat against a portion of the main body strap portion 220, the strap 196 can be pulled in a direction from the underside of the base 12, through the slot 208 in the base 12, through and out of the slot 202 in the seat 14.

Female buckle portion 190 includes a closed end 222 adjacent to and spaced from the post 216 and forming a slot 223 therebetween for reception of the proximal strap end 214. Female buckle portion 190 includes a closed end 224 opposite of the closed end 222. Female buckle portion 190 includes a ceiling 226 and a floor 228. Ceiling 226 includes an annular ridge 230 that confines a depressable button 232. Female buckle portion 190 includes a first open end 234 for receiving first buckle portion 192 and a second open end 236 for receiving second buckle portion 194.

Figure 15A:
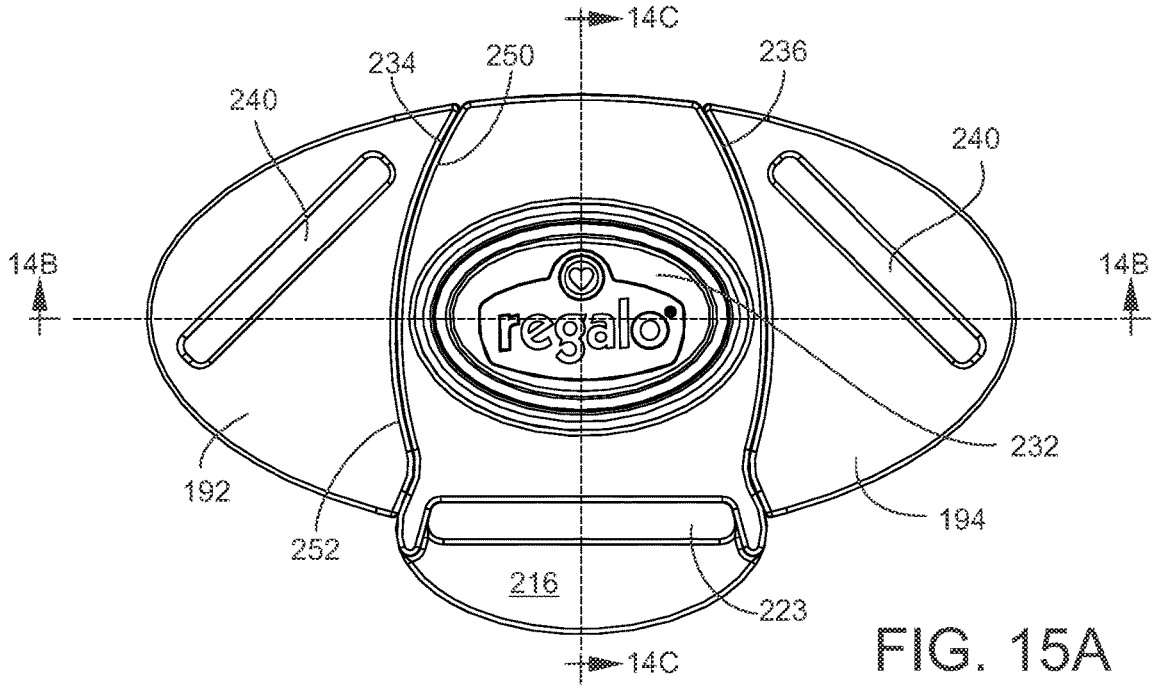
FIG. 15A is a top isolated view of engaged buckle portions of the strap apparatus of FIG. 14A without the strap portions.
Figure 15B:
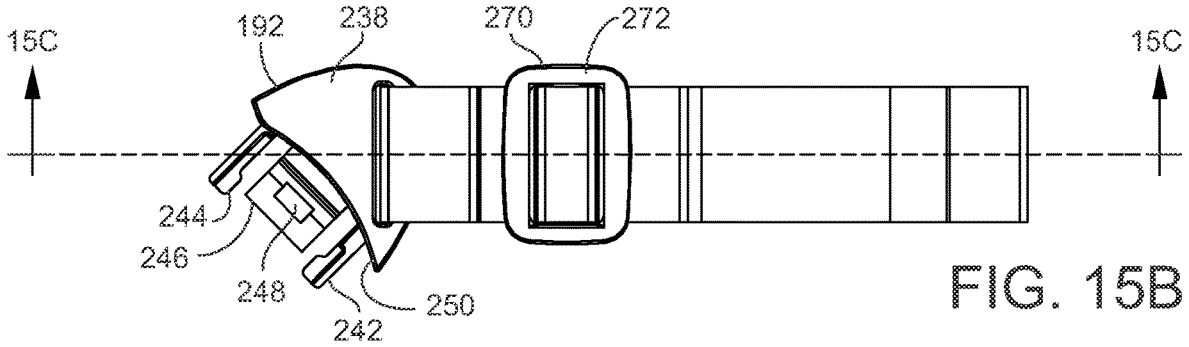
FIG. 15B is a top isolated view of a strap and buckle of the buckle apparatus of FIG. 14A.

FIG. 15B shows a top isolated view of the first buckle portion 192. Buckle portion 192 includes a base 238. The distal end of base 238 includes a slot 240 for engaging the proximal end of the strap 198. A pair of L-shaped prongs or keys 242 extend from the proximal end of the base 238. Each of the prongs or keys 242 includes a vertically extending outer flat face and a track 244. The track 244 accepts a ceiling ridge depending from the ceiling 226 of the female buckle portion 190. One prong or key 242 of one male buckle portion 192 or 194 includes a relatively long track 244, as shown in FIG. 15B. The other prong or key 242 of the same male buckle portion 192 or 194 includes a relatively short track 244, as shown in FIG. 15B. The associated ceiling ridge is keyed to its respective track 244 such that the ceiling ridge for the long track 244 has an end relatively close to the respective open end 234, 236 while the ceiling ridge for the short track 244 has an end relatively far from the respective open end 234, 236 such that buckle portion 192 is only accepted in open end 234 and such that buckle portion 194 is only accepted in open end 236. It should be noted here that male buckle portions 192, 194 are mirror opposites of each other such that the prong or key 242 having the relatively long track 244 is closest to end 222 on each of the male buckle portions 192, 194 when the male buckle portions 192, 194 are engaged to the female buckle portion 190. While prongs or keys 242 function as keys, prongs or keys 242 also minimize wobble of the male buckle portion 192, 194 when engaged in the female buckle portion 190. The vertically extending outer flat faces of the prongs or keys 242 confront the ends of open ends 234, 236, i.e., the inner faces of the end walls 222, 224, and also confront the inner surfaces of the ceiling 226 and floor 228 of the female buckle portion 190.

Disposed between, adjacent to, and spaced from prongs or keys 242 is a catch 246 formed in the shape of a plate with an opening 248. Buckle portion 192 includes an undulating off center eccentric vertically extending proximal face 250 that confronts in a unique singular way an undulating off center eccentric vertically extending edge 252 defining opening 234 of the female buckle portion 190. In combination with the L-shaped prongs or keys 242 that are received uniquely by the ceiling ridges of ceiling 226 inwardly of opening 234 and the undulating eccentric shapes of the open ends 234, 236, catch 246 is uniquely and singularly engagable with opening 234 and not opening 236.

Second buckle portion 194 is formed identically to and oppositely of first buckle portion 192 such that second buckle portion 194 is insertable into second opening 236 and engages female buckle portion 190 in a uniquely and singularly way and does not engage first opening 234. Second opening 236 of female buckle portion 190 and the structure within is identical to and a mirror opposite of first opening 234 and its structure within.

Button 232 includes an outer accessible end 254 that is pushed upon by a thumb or finger and an inner end 256. Between the outer end 254 and the inner end 256 is a downwardly extending central body portion 257 of the button 232. The annular ridge 230 defines a first opening of the female buckle portion 190, and the body portion 257 depends into and is confined by the edges of a second opening of female buckle portion 190 that is smaller than such first opening. Button body portion 257 includes an inner axial closed hole that receives a vertically extending guide 258 of female buckle portion 190. An inner half portion of button inner end 256 extends from the inner axial closed hole and an upwardly oblique or flared outer half portion 260 of the button inner end 256 extends from such inner half portion to a sidewall of the button body portion 257.

Female buckle portion 190 includes a first catch 262 and a second catch 264. Each of the catches 262, 264 includes a vertically extending inner face and an oblique outer face. Oblique outer face guides the free end of catch 246 of the respective male buckle portion downwardly until the pointed end of the respective catch 262 or 264 encounters opening 248, whereupon the respective catch 246 resiliently snaps audibly upwardly and opening 248 of catch 246 receives its respective catch 262 or 264 such that the respective catch 246 returns to its unbiased original position, whereupon the vertically extending inner face of the respective catch 262 or 264 holds the male buckle portion against disengagement. Such snap is audible to let the caregiver know that the male buckle portions 192, 194 are fully engaged with the female buckle portion 190. When so fully engaged, the upper face of button 232 rises from below or about the top of the annular ridge 230 to an altitude above the top of the annular ridge 230 to let the caregiver know from a visible perspective that the buckle portions 192, 194 are fully engaged in the female buckle portion 190. To disengage the respective male buckle portion, the button 232 is depressed, such that the flared outer end half portion 260 presses upon the resilient catch 246 such that resilient catch 246 resiliently flexes downwardly such that the respective pointed end of catch 262 or 264 clears the upper face of catch 246 of the respective male buckle portion such that the catch 246 and respective male buckle portion can be disengaged from the female buckle portion 190. Button 232 is continuously urged in the upward direction by the pair of catches 246, where one catch 246 is on each of the male buckle portions 192, 194. When button 232 is depressed, catches 246 flex resiliently and the male buckle portions 192, 194 may be removed from the female buckle portion 190. With male buckle portions 192, 194 removed from the female buckle portion 190, the button 232 passively lies at a lowermost state within annular ridge 230, where oblique edges 260 are disposed at a lower altitude than the apex of each of the first and second catches 262, 264 and where the oblique edges 260 are ready to be again engaged by the proximal free edges of catches 246. Button 232 is confined by female buckle portion 190, including annular ridge 230, guide 258, and the second opening within annular ridge 230 that surrounds button body portion 257 such that button 232 travels vertically up and down with minimal or no wobble and such that, when depressed, button 232 works on catches 246 at the same time such that male buckle portions 192, 194 are released at the same time such that straps 198, 200 are disengaged at the same time with one press of the button 232.

Figure 15C:
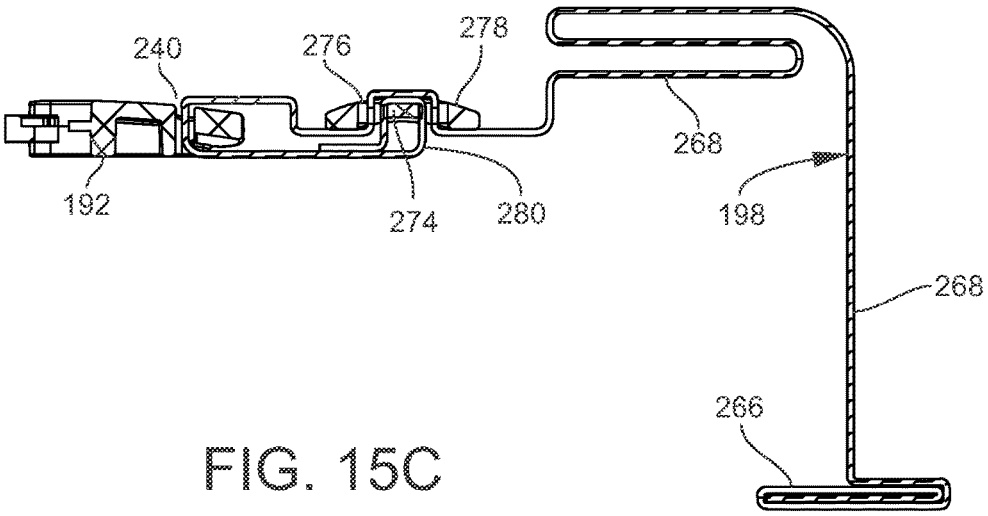
FIG. 15C is a section view at lines 15C-15C of FIG. 15B.

As shown in FIG. 15C, strap 198 includes a distal anchor end 266 and a main body strap portion 268. Distal anchor end 266 includes three and one-half layers of fabric stitched together. Distal end 266 engages the underside of the base 12 and prevents the strap 198 from being pulled through slots 210, 204 when the proximal faces of the distal end 266 engage the underside of the base 12 and when the distal end 266 is extending at a right angle to the main body strap portion 268. When the distal end 266 is pivoted to lay flat against a portion of the main body strap portion 268, the strap 198 can be pulled in a direction from the underside of the base 12, through the slot 210 in the base 12, and through and out of the slot 204 in the seat 14. In like manner strap 200 includes such a distal anchor end and such a main body strap portion and interacts in such a way with slots 212 and 206.

Strap 196 is not adjustable in length. Strap 196 has a set length. Straps 198 and 200 are adjustable in length.

Strap 198 includes a length adjustment buckle 270 with a rigid rectangular perimeter 272 and a rigid inner post 274 such that, on either side of the post 274, openings 276, 278 are formed. Strap 198 includes a distal strap loop end 280 that is permanently engaged about post 274. From the distal strap loop end 280, main body strap portion 268 sequentially extends upwardly through slot 240, upwardly through opening 276, downwardly through opening 278, and to distal anchor end 266. Rigid inner post 274 engages opposite portions of rigid perimeter 272. Strap 200 includes such identical parts and features.

When engaged, female buckle portion 190 and male buckle portions 192, 194 form the shape of an ellipse with the exception of a half-elliptical bulge being formed by the outer edge of the post 216. By the formation of an ellipse from a top view, the engaged buckle portions 190, 192, 194 cover a relatively wide portion of a child's belly or core or trunk so as to minimize a painful digging in of buckles or straps. Further, slot 223, slot 240 of buckle portion 192, and slot 240 of buckle portion 194 define straight lines that are set obliquely relative to each other. Still further slot 240 of buckle portion 192 is disposed obliquely relative to prongs or keys 242 of buckle portion 192. Likewise, slot 240 of buckle portion 194 is disposed obliquely relative to prongs or keys 242 of buckle portion 194.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A floor seat apparatus for resting on a surface, comprising:

a) a base that comprises:
- i) an outer wall;
- ii) an inner wall, the inner wall spaced from the outer wall;
- iii) an integral base bottom integrally joined the inner wall;
- iv) the outer and inner walls integrally joined at an integral upper junction such that the base is integral and one-piece;
- v) a post and first and second leg openings, the post extending upwardly and being between the first and second leg openings; and
- vi) the inner wall and the integral base bottom defining a seat receptacle;

b) a seat, the seat being removably seatable in the seat receptacle of the base, the seat comprising:
- i) a seat bottom; and
- ii) first and second leg receptors and a post through opening between the first and second leg receptors, the post through opening receiving the post of the base when the seat is seated in the base; and c) a strap apparatus, the strap apparatus comprising:
- i) first, second, and third straps, each of the first, second, and third straps anchorable to the base and extendable through the seat bottom;
- ii) a first male buckle portion engaged to the first strap;
- iii) a second male buckle portion engaged to the second strap; and
- iv) a female buckle portion engaged to the third strap, the female buckle portion engaging each of the first and second male buckle portions.

2. The floor seat apparatus of claim 1, wherein each of the first, second, and third straps includes a proximal strap end and a distal strap end, wherein each of the distal strap ends is anchorable to the base, wherein the seat includes first, second, and third slots, the first, second, and third straps extending through the first, second, and third slots, respectively, wherein the proximal strap end of the first strap is engaged to the first male buckle portion, wherein the proximal strap end of the second strap is engaged to the second male buckle portion, and wherein the proximal strap end of the third strap is engaged to the female buckle portion.

3. The floor seat apparatus of claim 1, wherein the female buckle portion includes a first receptor for receiving the first male buckle portion and a second receptor for receiving the second male buckle portion, a first structure between the first receptor and first male buckle portion being different than a second structure between the second receptor and second male buckle portion such that the first receptor cooperates only with the first male buckle portion and such that the second receptor cooperates only with the second male buckle portion.

4. The floor seat apparatus of claim 3, wherein said first structure is disposed on a first key on the first male buckle portion, the first key entering and locking with the first receptor of the female buckle portion, and wherein said second structure is a second key on the second male buckle portion, the second key entering and locking with the second receptor of the female buckle portion.

5. The floor seat apparatus of claim 3, wherein said first structure is an eccentric face on the first male buckle portion that cooperates with a first face on the female buckle portion, and wherein said second structure is an eccentric face on the second male buckle portion that cooperates with a second face on the female buckle portion.

6. The floor seat apparatus of claim 1, wherein the female buckle portion includes a button and an endless ridge disposed immediately about the button, the button disengaging the first and second male buckle portions from the female buckle portion when the button is depressed, the button having a button top, the endless ridge having an endless ridge top, the button top having a first position relative to the endless ridge top when the first and second male buckle portions are disengaged from the female buckle portion, the button top having a second position relative to the endless ridge top when the first and second male buckle portions are engaged to the female buckle portion.

7. The floor seat apparatus of claim 1, wherein the first male buckle portion includes a first slot through which the first strap extends, wherein the second male buckle portion includes a second slot through which the second strap extends, wherein the female buckle portion includes a third slot through which the third strap extends, wherein each of the first, second, and third slots defines first, second, and third straight axes, wherein the first axis is oblique relative to the third axis, and wherein the second axis is oblique relative to the third axis.

* * * * *